US008139973B2

(12) United States Patent
Ishikawa et al.

(10) Patent No.: US 8,139,973 B2
(45) Date of Patent: Mar. 20, 2012

(54) AIR DISCHARGING APPARATUS AND IMAGE FORMING APPARATUS

(75) Inventors: Chuuji Ishikawa, Kanagawa (JP); Kunio Hibi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 329 days.

(21) Appl. No.: 12/425,571

(22) Filed: Apr. 17, 2009

(65) Prior Publication Data

US 2009/0274493 A1 Nov. 5, 2009

(30) Foreign Application Priority Data

Apr. 30, 2008 (JP) ..... 2008-118734
Sep. 3, 2008 (JP) ..... 2008-225963

(51) Int. Cl.

| | |
|---|---|
| ***G03G 21/20*** | (2006.01) |
| ***F04B 7/00*** | (2006.01) |
| ***F04B 27/047*** | (2006.01) |
| ***F04B 49/00*** | (2006.01) |

(52) U.S. Cl. ..... 399/92; 399/320; 399/323; 399/355; 417/63; 417/313

(58) Field of Classification Search ..... 399/91, 399/92, 320, 322, 323, 355; 219/216, 469–471; 417/63, 313, 437

See application file for complete search history.

(56) References Cited

U.S. PATENT DOCUMENTS

| | | | | |
|---|---|---|---|---|
| 3,449,924 | A | 6/1969 | Sudmeier | |
| 3,955,813 | A | 5/1976 | Edwards | |
| 4,257,054 | A | 3/1981 | Ishikawa | |
| 5,132,740 | A | 7/1992 | Okamoto et al. | |
| 5,836,747 | A * | 11/1998 | Gondek | 417/63 |
| 6,095,758 | A * | 8/2000 | Chou | 417/63 |
| 6,162,030 | A * | 12/2000 | Pierrat | 417/497 |
| 6,200,111 | B1 * | 3/2001 | Foss | 417/515 |
| 6,595,907 | B1 | 7/2003 | Ishikawa et al. | |
| 7,040,806 | B2 | 5/2006 | Ishikawa et al. | |
| 2007/0147912 | A1 * | 6/2007 | Fujii | 399/323 |

FOREIGN PATENT DOCUMENTS

| | | |
|---|---|---|
| FR | 2 520 059 | 7/1983 |
| GB | 1 480 247 | 7/1977 |
| JP | 57-46794 | 10/1982 |
| JP | 3-32878 | 2/1991 |
| JP | 2005-157179 | 6/2005 |
| JP | 2007-178732 | 7/2007 |
| JP | 2007-187715 | 7/2007 |
| JP | 2007-187791 | 7/2007 |
| JP | 2007-199462 | 8/2007 |
| JP | 2007-206153 | 8/2007 |
| JP | 2007-212922 | 8/2007 |
| JP | 2007-225846 | 9/2007 |

(Continued)

*Primary Examiner* — David Porta
*Assistant Examiner* — Jessica L Eley
(74) *Attorney, Agent, or Firm* — Oblon, Spivak, McClelland, Maier & Neustadt, L.L.P.

(57) ABSTRACT

An air discharging apparatus to discharge pressurized air at a predetermined timing is disclosed. The disclosed air discharging apparatus includes an air pump including a cylinder and a piston configured to reciprocate in the cylinder; an opening and closing member provided at an air discharge opening of the air pump and configured to open and close the air discharge opening; and a switching mechanism providing mechanical coupling between the piston and the opening and closing member. The mechanical coupling keeps the opening and closing member in a closed state until the piston reaches a predetermined position in a compression stroke and switches the opening and closing member to an opened state when the piston reaches the predetermined position.

17 Claims, 30 Drawing Sheets

FOREIGN PATENT DOCUMENTS

| | | |
|---|---|---|
| JP | 2007-233228 | 9/2007 |
| JP | 2007-240920 | 9/2007 |
| JP | 2007-240921 | 9/2007 |
| JP | 2007-248679 | 9/2007 |
| JP | 2008-3277 | 1/2008 |
| WO | WO 98/50166 | 11/1998 |

* cited by examiner

AIR DISCHARGING APPARATUS AND IMAGE FORMING APPARATUS

BACKGROUND OF THE INVENTION

1. Field of the Invention

The present invention generally relates to an air discharging apparatus which discharges pressurized air, and to an image forming apparatus including the air discharging apparatus.

2. Description of the Related Art

Patent Document 1: Japanese Patent Application Publication No. 2005-157179

Patent Document 2: Japanese Patent Application Publication No. 2008-003277

There is a known air supply apparatus or an air supply system for supplying pressurized air, which is used in various industrial apparatuses, production equipment, and the like. FIG. 34 is a block diagram showing a configuration example of a conventional air supply system. The system shown in FIG. 34 includes a compressor 601, an air tank 602, an electromagnetic valve 603, and an air nozzle 604. Although not shown here, a driving source for driving the compressor, a pressure sensor for controlling pressure, and the like are also required.

A conventional air supply apparatus (air supply system) constituted as described above has been unavoidably large in size. Moreover, since it takes time to compress air by the compressor (for example, about one minute) to obtain a high pressure air, the high pressure air cannot be used right after the air supply apparatus is started. Further, a large number of whole components such as the electromagnetic valve are required, which leads to a very high cost. Furthermore, the compressor is noisy when operating, and energy saving is difficult since the air supply apparatus with a large configuration consumes a large amount of power. Due to these problems, applications of the conventional air supply apparatus have been limited to commercial uses such as industrial apparatuses and production equipment.

In the field of image forming apparatuses, there is an image forming apparatus that uses air to separate or transfer paper in a paper feed unit or separate (peel off) paper in a fixing unit (for example, Patent Documents 1 and 2). As described above, however, a conventional air supply apparatus (air supply system) has been large in size. Thus, an image forming apparatus including the air supply apparatus has been limited to a large commercial printing apparatus operated by a professional operator, and the like. It has been difficult to employ functions of air separation, air transfer, and the like in a multifunction peripheral, a printer, and the like for uses in a general office and the like.

It is not difficult to downsize only an air pump, however, a small size and low cost air discharging apparatus, which is capable of increasing an air pressure to a required pressure and discharging the pressurized air at a predetermined timing, has not been realized yet.

SUMMARY OF THE INVENTION

It is an object of at least one embodiment of the present invention to provide a small size and low cost air discharging apparatus, which solves the above-described problems of the conventional air supply apparatus and can discharge pressurized air at a predetermined timing without using a compressor and an electromagnetic valve.

Moreover, it is also an object of at least one embodiment of the present invention to provide a fixing apparatus and an image forming apparatus, which have a small size and low cost air discharging apparatus and can perform reliable paper separation (peel off).

According to one aspect of the present invention, an air discharging apparatus to discharge pressurized air at a predetermined timing is provided. The air discharging apparatus includes an air pump including a cylinder and a piston configured to reciprocate in the cylinder; an opening and closing member provided at an air discharge opening of the air pump and configured to open and close the air discharge opening; and a switching mechanism providing mechanical coupling between the piston and the opening and closing member. The mechanical coupling is configured to keep the opening and closing member in a closed state until the piston reaches a predetermined position in a compression stroke and switch the opening and closing member to an opened state when the piston reaches the predetermined position.

DETAILED DESCRIPTION OF THE PREFERRED EMBODIMENTS

Embodiments of the present invention are described with reference to the drawings below.

Figure 1:
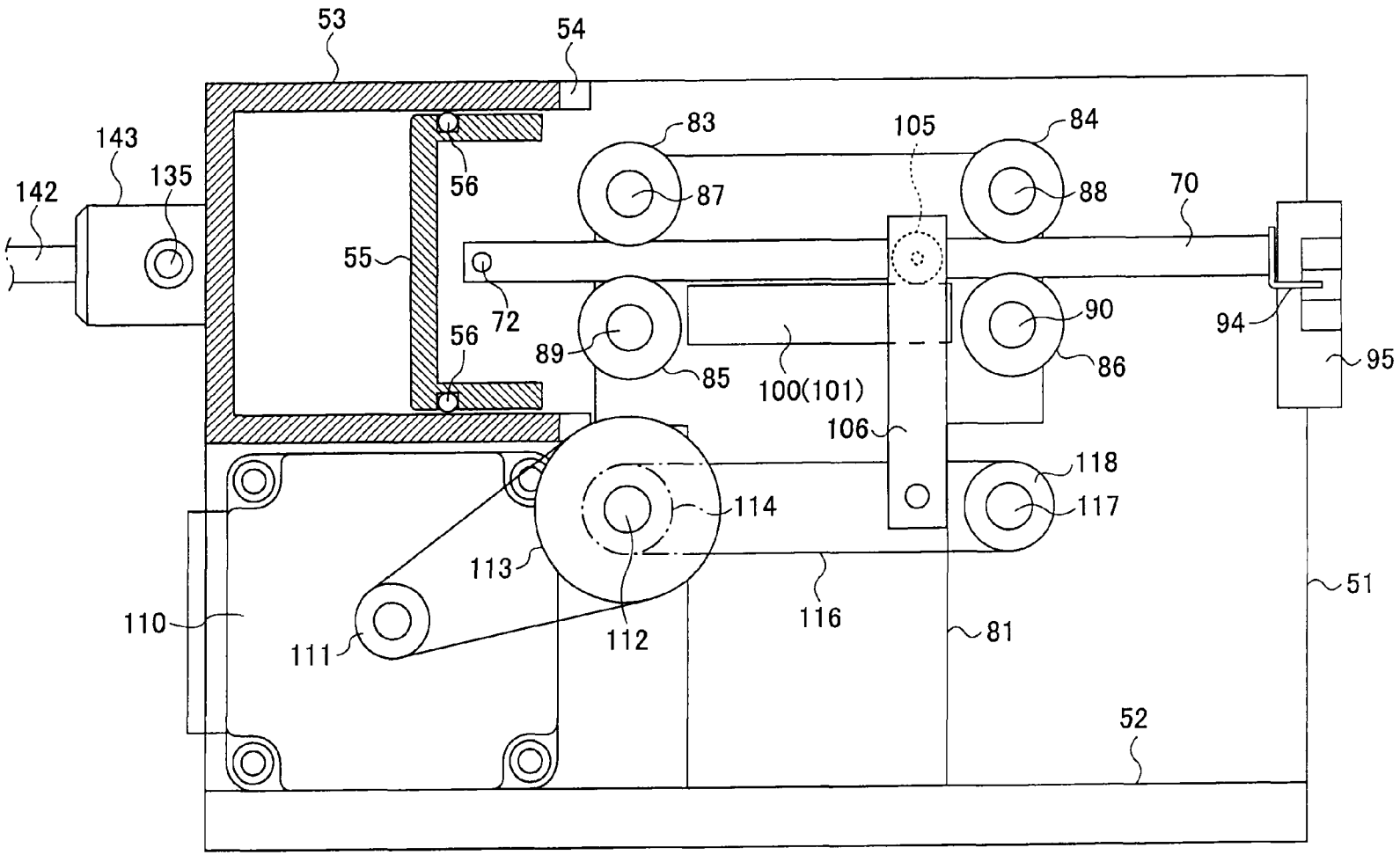
FIG. 1 is a vertical cross-sectional view of an air discharging apparatus of one embodiment of the present invention, seen in a direction from a front.
Figure 2:
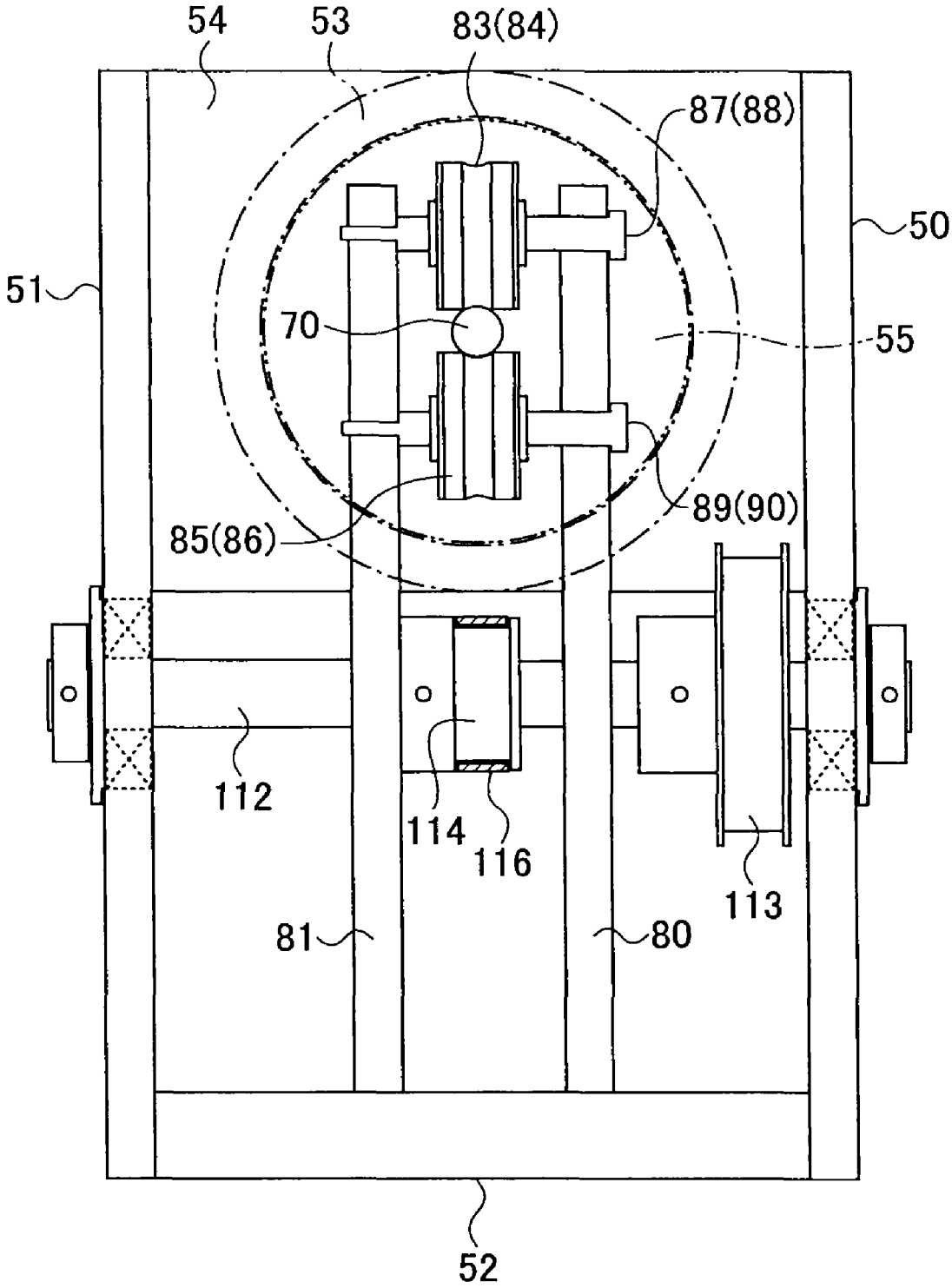
FIG. 2 is a vertical cross-sectional view of the air discharging apparatus seen in a direction from a side surface.
Figure 3:
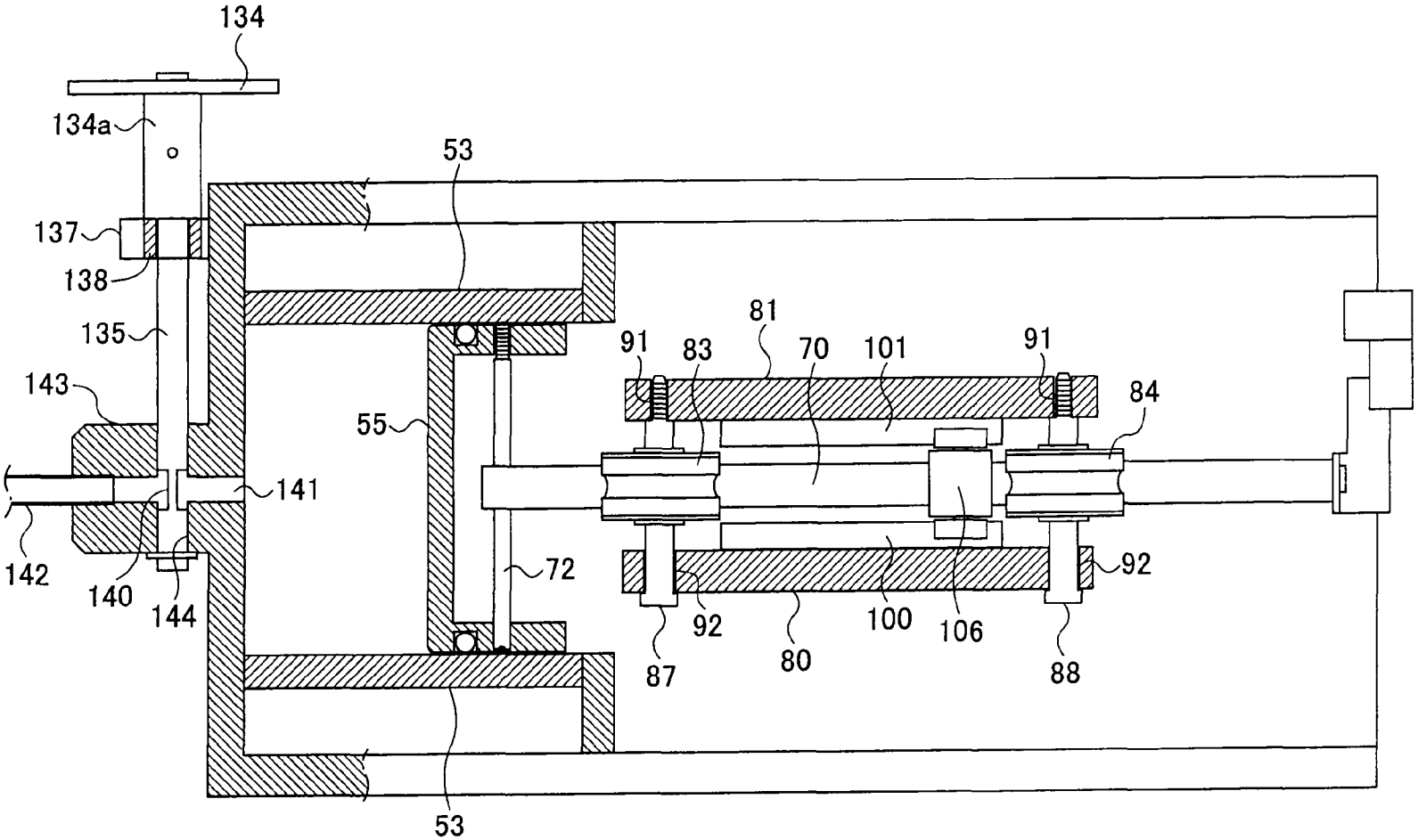
FIG. 3 is a plane cross-sectional view showing a configuration of a pump unit of the air discharging apparatus.
Figure 4:
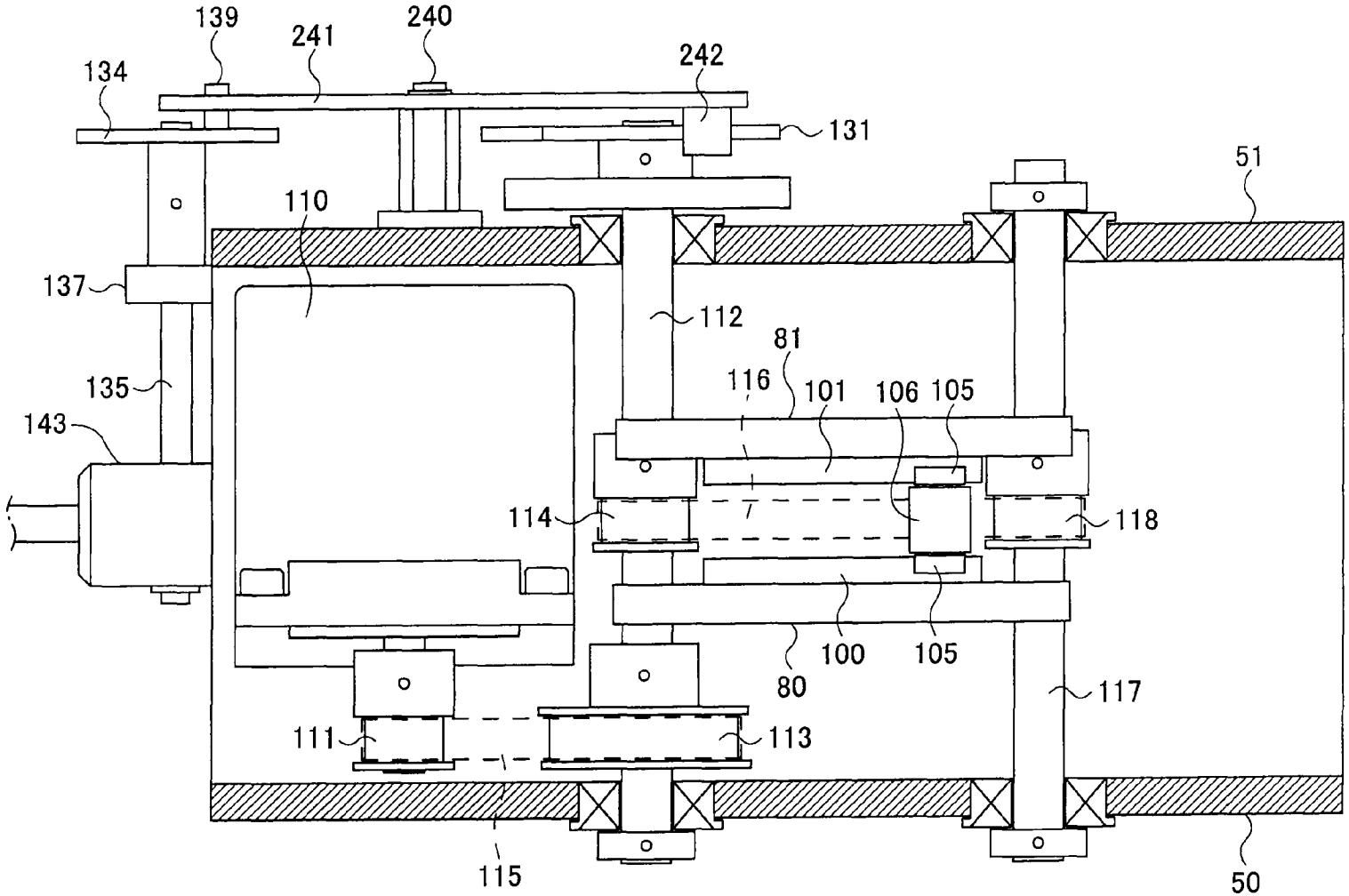
FIG. 4 is a plane cross-sectional view showing a vicinity of a driving unit.
Figure 5:
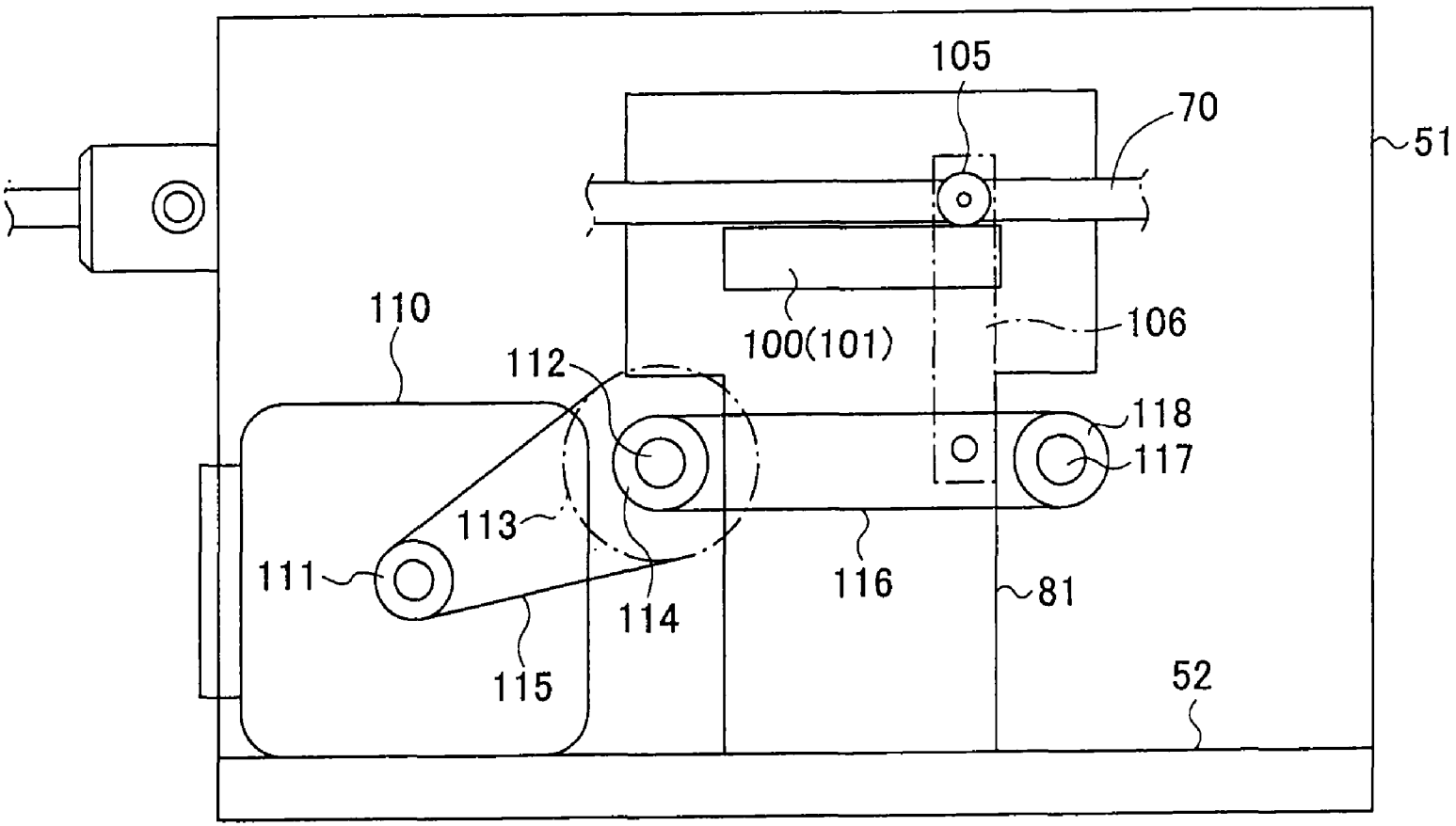
FIG. 5 is a vertical cross-sectional view of the air discharging apparatus seen in a direction from a front, with parts of components omitted.
Figure 6:
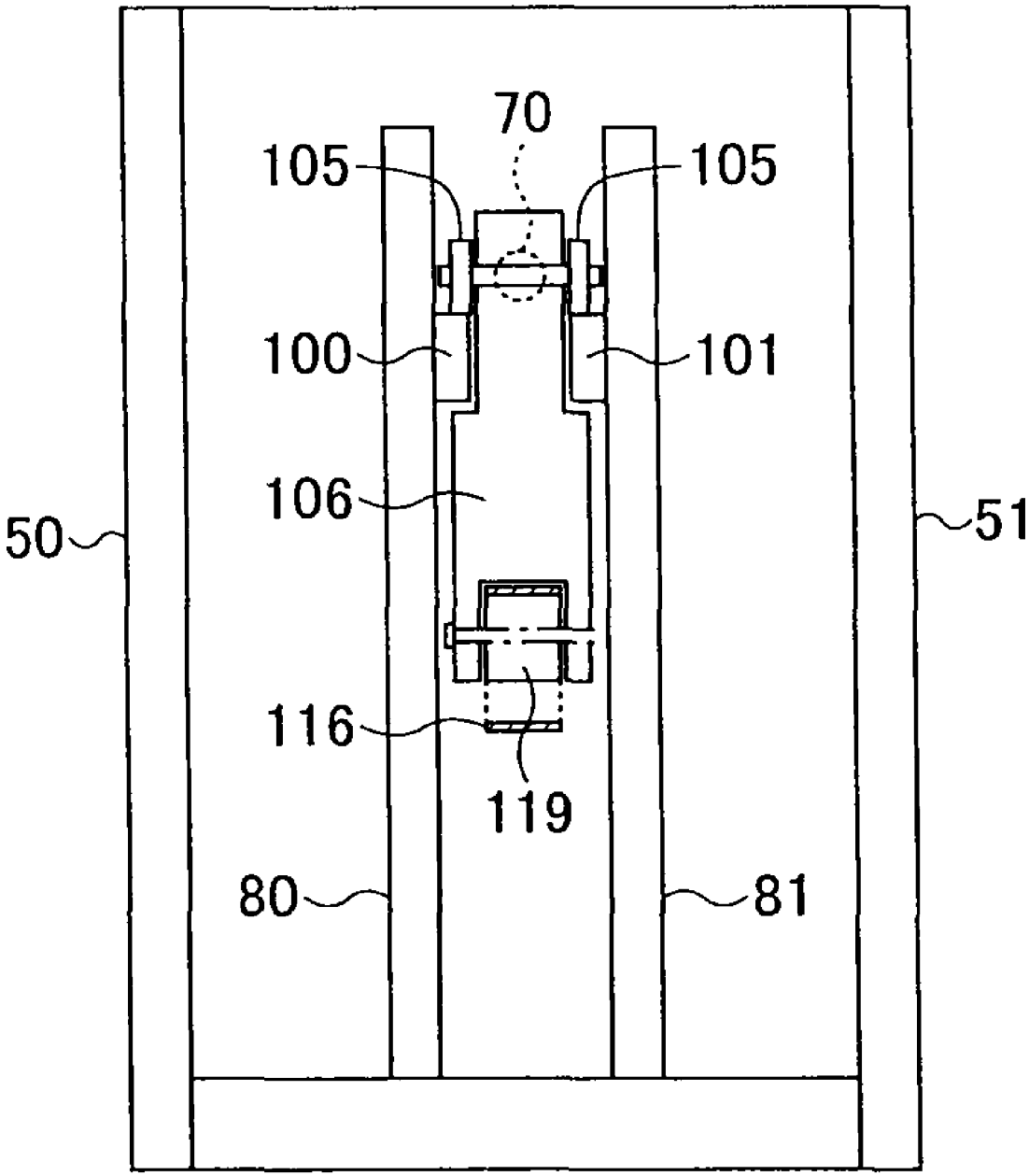
FIG. 6 is a vertical cross-sectional view of the air discharging apparatus seen in a direction from a right in FIG. 1, with parts of components omitted.

FIG. 1 is a vertical cross-sectional view of an air discharging apparatus seen in a direction from a front, showing an embodiment of an air discharging apparatus according to the present invention. FIG. 2 is a vertical cross-sectional view of the air discharging apparatus seen in a direction from a side surface, which is a left direction in FIG. 1. FIG. 3 is a plane cross-sectional view showing a configuration of a pump unit in the air discharging apparatus. Moreover, FIG. 4 is a plane cross-sectional view showing a vicinity of a driving unit. FIG. 5 is a vertical cross-sectional view of the air discharging apparatus seen in a direction from the front, with some components being omitted to show a configuration of a driving system clearly. FIG. 6 is a vertical cross-sectional view of the air discharging apparatus seen in a direction from the right in FIG. 1, with some components being omitted to show the configuration of the driving system clearly.

As shown in these drawings, an air discharging apparatus 500 includes front and back side boards 50 and 51, and a bottom board 52 which constitute an apparatus housing. Between the front and back side boards 50 and 51, a cylinder 53 and a cylinder holding board 54 are fixed to the front and back side boards 50 and 51 by screws. The cylinder holding board 54 is a member for supporting the cylinder 53 from a back. A piston 55 is provided in the cylinder 53. The piston 55 is reciprocated in left and right directions in FIG. 1 by a mechanism described below. A boss 143 is provided in a protruding manner on a front end surface of the cylinder 53. In the boss 143, an air discharge opening 141 (FIG. 3) for discharging air in the cylinder 53 is provided. A tube 142 is set in a front end part of the air discharge opening 141. Air pressurized by the movement of the piston 55 in the cylinder 53 is discharged from the air discharge opening 141 through the tube 142 to outside. Below, a configuration and an operation of the air discharging apparatus 500 are described in detail.

A pair of holding boards 80 and 81 are provided in a standing manner on the bottom board 52. Four rod shafts 87 to 90 are supported by the holding boards 80 and 81. One end part of each rod shaft is a screw part while the other end part of each rod shaft is a large diameter part for retaining the rod shaft so as not to fall out. An end surface of the large diameter part has a groove which allows tightening of the screw by using a screwdriver and the like. In parts of the holding boards 80 and 81 where the rod shafts are assembled, four screw holes 91 (two each in top and bottom) are formed in the holding board 80 in the back, and four through-holes (fitting holes) 92 (two each in top and bottom) are formed in the holding board 81 in the front. That is, the rod shafts 87 to 90 are inserted in the fitting holes 92 of the holding board 81 in the front and the screw parts at the front ends of the rod shafts 87 to 90 are then screwed in the screw holes 91 of the holding board 80 in the back. As a result, the rod shafts 87 to 90 are fixed and supported between the front and back holding boards 80 and 81. Guiding rollers 83 to 86 are rotatably mounted about the rod shafts 87 to 90 respectively. Positions of the guiding rollers 83 to 86 in the shaft direction are determined by E-rings (retaining rings) mounted about the rod shafts on opposing sides of the guide rollers 83 to 86. A central part of each of the guiding rollers 83 to 86 in the shaft direction is smaller in diameter than other opposing sides as shown in FIGS. 2 and 3. A circumferential surface of the central small diameter part is formed in a rounded shape (depressed shape) to fit an outer shape of a guiding shaft 70 (a circular cross section in this example). Note that the central small diameter part of each of the guiding rollers 83 to 86 may be formed in a V-shape.

The guiding shaft 70 is provided between the guiding rollers 83 and 84, and the guiding rollers 85 and 86, which are arranged in right and left parts in top and bottom. The guiding shaft 70, being guided by the guiding rollers 83 to 86, is capable of linearly moving in left and right directions in FIGS. 1 and 3. Positions of the screw holes 91 and the fitting holes 92 in the front and back holding boards 80 and 81 are processed with a high precision so that the guiding shaft 70 moves smoothly without a jolt between the guiding rollers 83 to 86 and the guiding shaft 70. As described above, the guiding rollers 83 to 86 sandwich the guiding shaft 70 from above and beneath and the positions of the guiding rollers 83 to 86 in the shaft direction with respect to the rod shafts 87 to 90 are determined by the E-rings (retaining rings). Therefore, when the guiding shaft 70 moves, the guiding shaft 70 can linearly move (horizontal movement in this example) with a favorable precision without displacing in a front, back, upward, or downward direction.

The piston 55 provided in the cylinder 53 is mounted to a front end (left end part in FIG. 1) of the guiding shaft 70, with a rod 72 interposed therebetween. An O-ring 56 is fit in a groove part provided in the vicinity of the front end part of the piston 55. A filler 94 for detecting a position of the piston 55 is screwed to be fixed in a rear end (right end part in FIGS. 1 and 3) of the guiding shaft 70. A transmission type optical sensor is used as a sensor 95 for detecting the filler 94 in this embodiment. When the guiding shaft 70 moves to the right direction in FIGS. 1 and 3 and a front end of the filler 94 blocks the light of the sensor 95, a driving motor, which is described below, is stopped. In this embodiment, this position shown in FIGS. 1 and 3 is a home position (HP) of the pump mechanism formed as described above.

The cylinder 53 and the piston 55 are both in cylindrical shapes in this embodiment. As described above, the cylinder 53 and the piston 55 are configured so that the guiding shaft 70 can linearly move with a favorable precision. Therefore, the piston 55 reciprocates (parallel movement to the cylinder) with a favorable precision in the cylinder 53. Here, not only the parallel movement (linear movement) of the piston 55 is essential in this pump mechanism, but a rotation stopper for the piston 55 is also important. That is, in this embodiment, when the piston 55 rotates, the guiding shaft 70 and the filler 94 connected to the guiding shaft 70 rotate as well. When the filler 94 rotates, the filler 94 does not enter a detecting part of the sensor 95 but hits the body of the sensor 95. In this embodiment, a belt driving method is employed as described below. Therefore, the operation becomes unstable since the rotation of the piston 55 tilts the driving belt.

Figure 7:
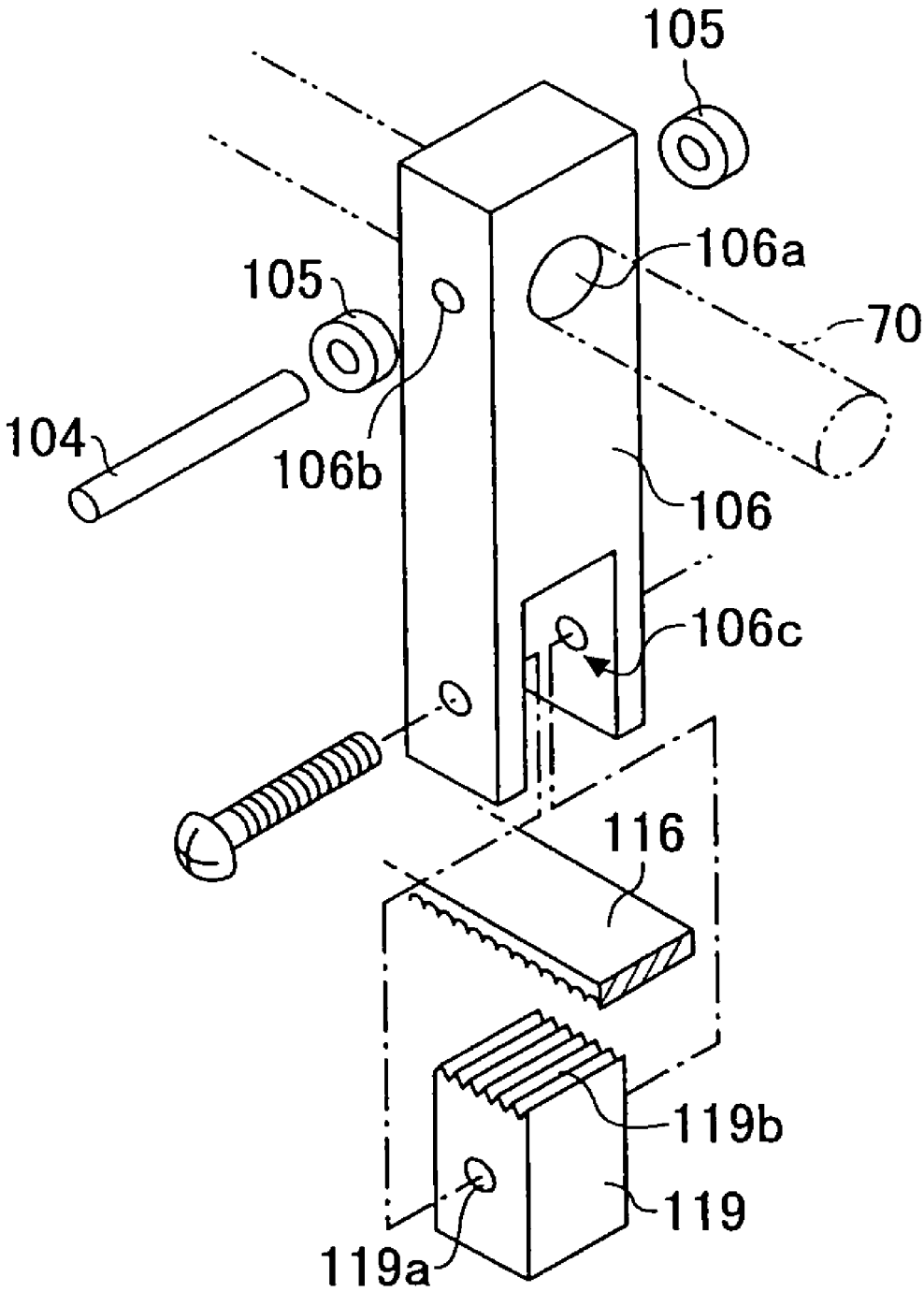
FIG. 7 is a perpendicular view showing a coupling configuration of a driving belt and a guiding shaft.

In view of this, the piston 55 is configured so as not to rotate in this embodiment. As shown in FIGS. 3 to 6, rails 100 and 101 are provided facing each other on side surfaces of top parts of the front and back holding boards 80 and 81, respectively in this embodiment. As shown in FIGS. 6 and 7, a driving arm 106 is mounted to the guiding shaft 70 to fit therewith (the guiding shaft 70 passes through a guiding shaft inserting hole 106*a* provided in a top part of the driving arm 106). Further, the driving arm 106 has a shaft hole 106*b* passing through in a direction vertically crossing the guiding shaft inserting hole 106*a*. A shaft 104 is inserted in the shaft hole 106*b*. The shaft 104 is pressed into a through-hole, which is not shown, provided in the guiding shaft 70, so that the shaft 104 vertically crosses the guiding shaft 70. Rollers 105 are rotatably mounted to opposing end parts of the shaft 104, so that the rollers 105 move on the rails 100 and 101. The rollers 105 are retained by E-rings which are not shown, so as not to fall out of the shaft 104. In this manner, the rollers 105 are mounted to the opposing ends of the shaft 104 which is pressed into the guiding shaft 70 so that the rollers 105 contact and move on the rails 100 and 101. As a result, the rotation of the piston 55 mounted to the guiding shaft 70 is prevented (even when the piston 55 tries to rotate, the rotation is prevented by the roller 105 contacting the rail 100 or 101.)

Next, a mechanism to drive the piston 55 is described. As shown in FIGS. 1, 4, and 5, the air discharging apparatus of this embodiment includes a stepping motor 110 as a driving source. The stepping motor 110 has a motor shaft, to which a pulley 111 is mounted and fixed. A pulley 113 is mounted and fixed to a driving shaft 112 supported between the front and back side boards 50 and 51. A first driving belt (timing belt) 115 is wrapped around the pulleys 111 and 113. A driving pulley 114 is mounted and fixed about the driving shaft 112. Further, an idler pulley 118 is mounted and fixed about an idler shaft 117 supported between the front and back side boards 50 and 51 in parallel to the driving shaft 112. A second driving belt (timing belt) 116 is wrapped around the driving pulley 114 and the idler pulley 118.

As shown in FIGS. 6 and 7, a bottom end part of the driving arm 106 coupled to the guiding shaft 70 is formed in an upside-down squared U-shape, which serves as a belt mounting part 106. By screwing a belt fixing piece 119 to the belt mounting part 106 of the driving arm 106 with a top side part of the second driving belt 116 sandwiched therebetween, the second driving belt 116 is fastened and fixed to the driving arm 106. A screw through-hole 119*a* provided in the belt fixing piece 119 is a long hole, which allows screwing with the driving arm 106 in a state that the second driving belt 116 is tightly pressed onto the driving arm 106 when sandwiching the second driving belt 116. A top surface 119*b* of the belt fixing piece 119 has a shape with a depression and a projection corresponding to a shape of an inner circumference of the second driving belt 116, so that the second driving belt 116 does not slip when fastened with the belt fixing piece 119.

Figure 8:
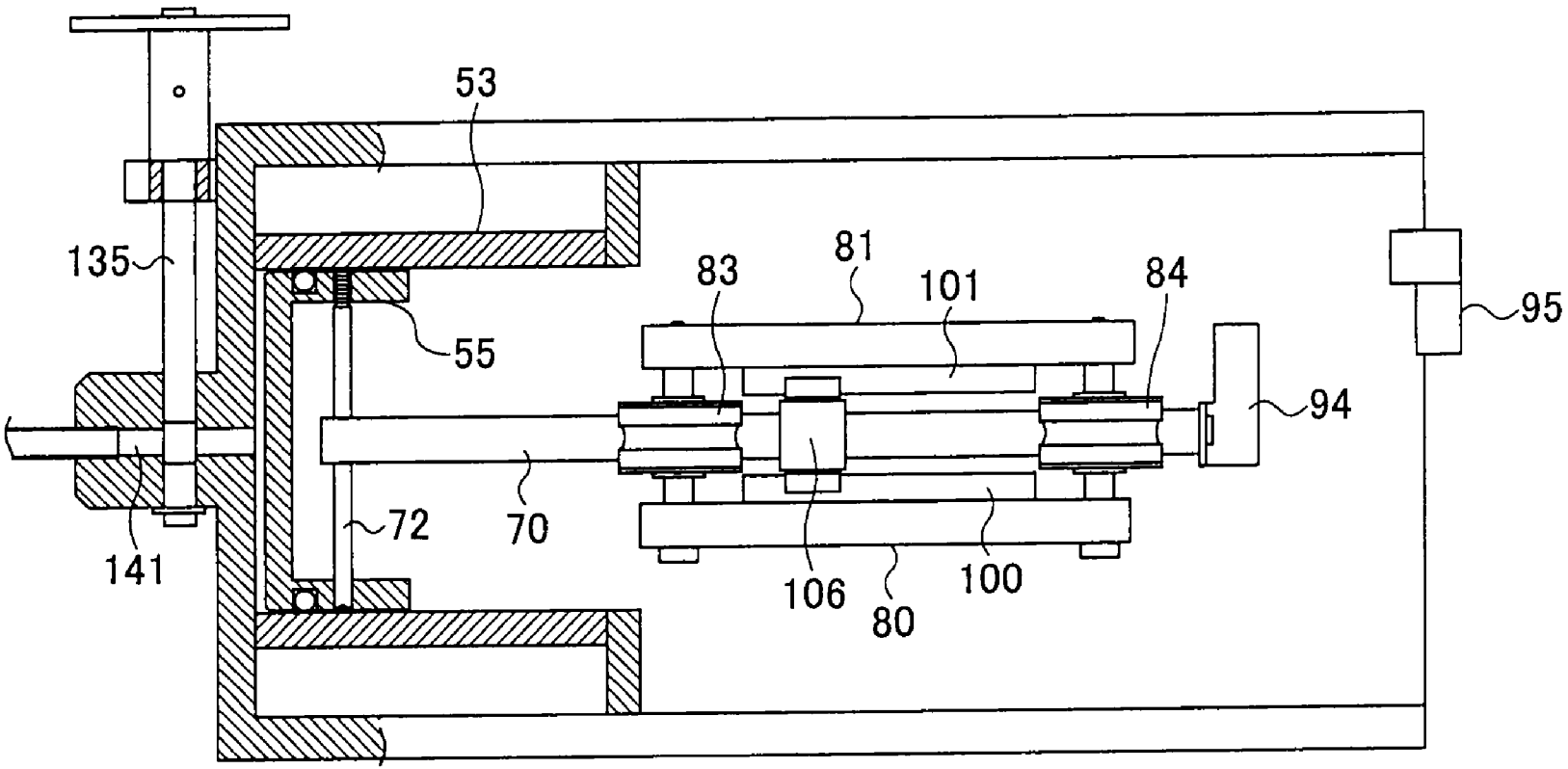
FIG. 8 is a plane cross-sectional view showing a state in which a piston has moved to a compressing position (top dead point)
Figure 9:
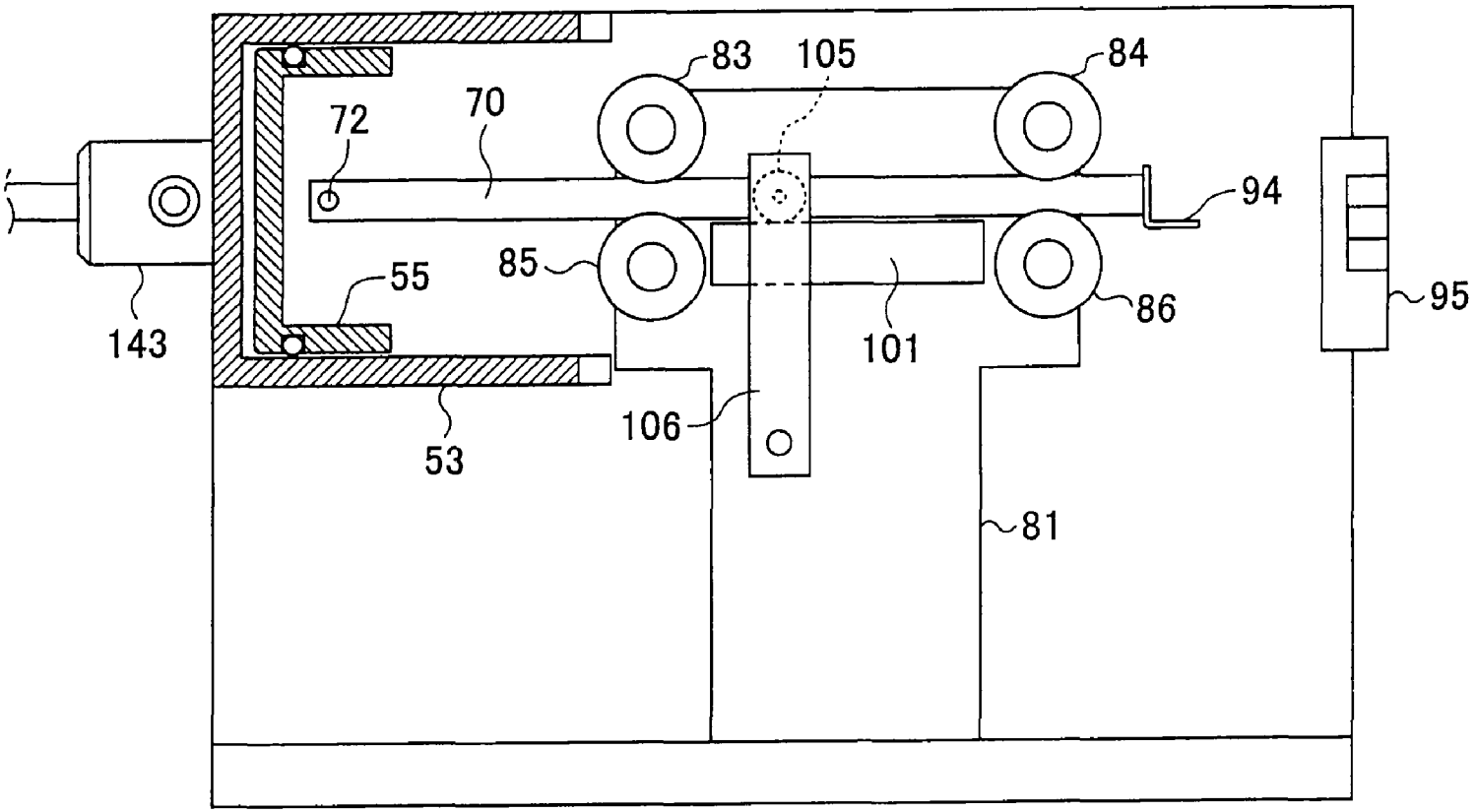
FIG. 9 is a vertical cross-sectional view showing a state in which the piston has moved to the compressing position (top dead point)

In such a configuration, a rotation of the stepping motor 110 is transmitted via the first driving belt 115 to the driving shaft 112, and further transmitted from the driving shaft 112 via the second driving belt 116 to the driving arm 106. As a result, the guiding shaft 70 coupled to the driving arm 106 is moved in the shaft direction of the guiding shaft 70 (left and right directions in FIGS. 1, 3, and 5). Consequently, the piston 55 moves in the cylinder 53. In this embodiment, the stepping motor 110 is used as the driving source of the air discharging apparatus. The number of steps of the stepping motor 110 is set so that the piston 55 moves a distance of a stroke between the home position shown in FIGS. 1 and 3 (a bottom dead point where a cylinder volume is maximum is set as the home position (HP) in this embodiment) and a compressing position (top dead point) where the cylinder volume is minimum. In an actual control, when the power of the air discharging apparatus is turned on, the home position is recognized based on an output of the sensor 95 and the piston stops at the home position. The stepping motor 110 rotates (counterclockwise in FIG. 1, which is a normal rotation hereinafter) so that the piston 55 moves a distance of a stroke set in a compressing direction with the above position of the piston 55 as a reference. Subsequently, the stepping motor 110 reversely rotates (clockwise in FIG. 1) so that the piston 55 returns a distance of the same stroke to the home position. By this one reciprocating operation of the piston 55, operations of compressing air, discharging air, and introducing air are completed. A plane cross-sectional view and a vertical cross-sectional view of the piston 55 which has moved to a compressing position are shown in FIGS. 8 and 9, respectively.

Figure 10:
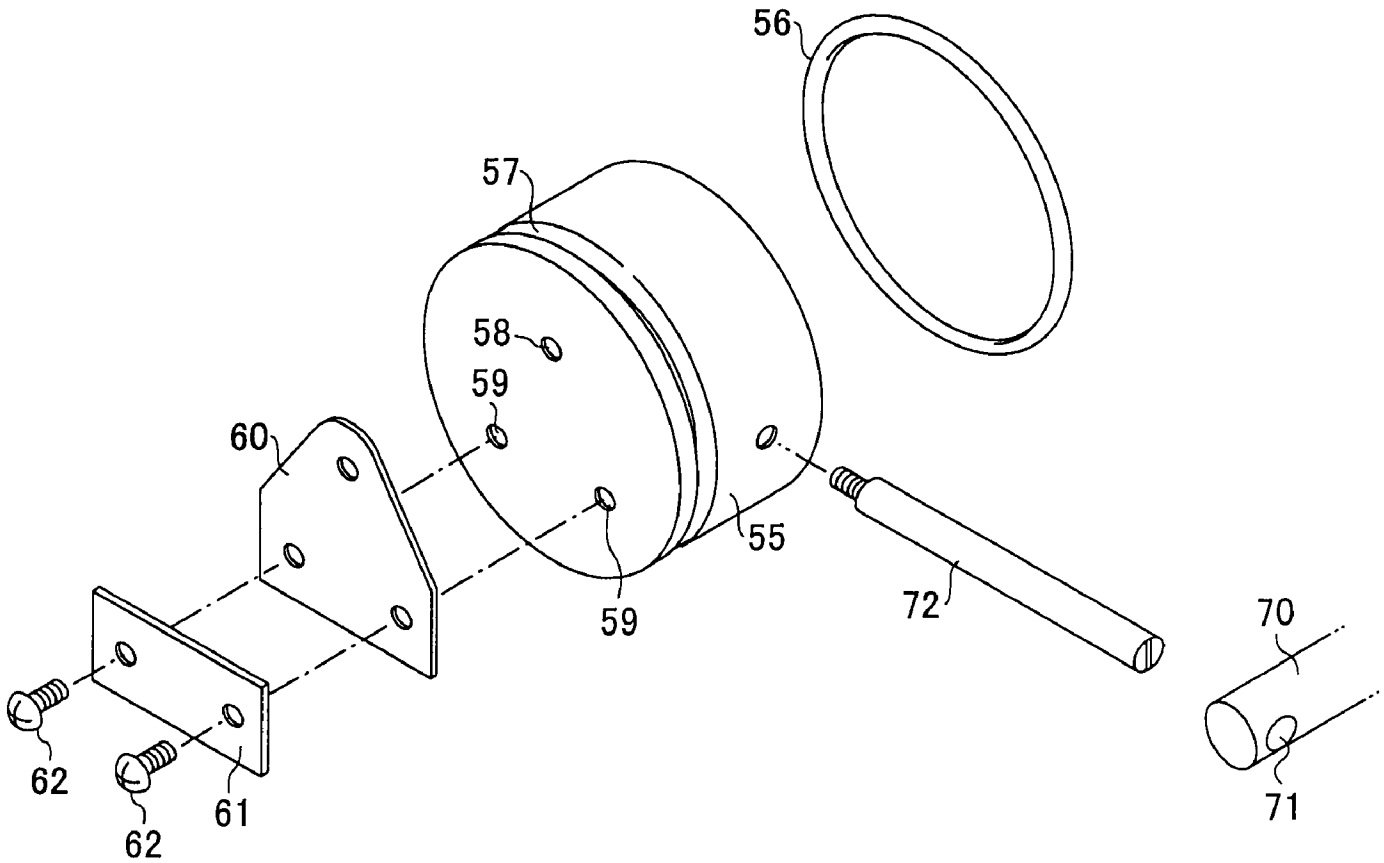
FIG. 10 is a partial enlarged view showing a front end part of the piston.
Figure 11A:
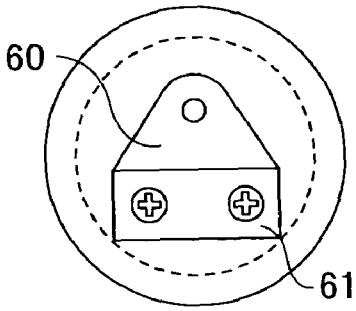
FIG. 11A is a side view showing a front end part of a piston and FIG. 11B is a cross-sectional view of the front end part.

FIG. 10 is a partial enlarged view showing the front end part of the piston 55. FIG. 11A is a side view of the piston 55, showing a front end surface of the piston 55, and FIG. 11B is a cross-sectional view of the front end part of the piston 55.

Figure 11B:
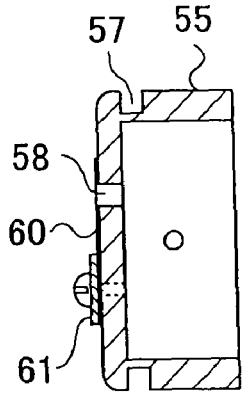

As shown in FIGS. 10, 11A, and 11B, the front end surface of the piston 55 is provided with an air inlet 58 communicating between inside and outside of the piston 55. A leaf valve 60 in a substantial triangle shape is fixed to the front end surface of the piston 55 with a pressing board 61 interposed therebetween, so that the air inlet 58 can be closed. Reference numerals 59 denote screw holes provided in the front end surface of the piston 55. Reference numerals 62 denote screws for fixation. In the initial state, the leaf valve 60 closes the air inlet 58 by tightly contacting the front end surface of the piston 55 without a space. The leaf valve 60 is formed of, for example, a polyester film or a stainless steel with a thickness of 0.05 to 0.2 mm. Since the leaf valve 60 has flexibility, the leaf valve 60 can return to its original condition even when pressed.

When the piston 55 moves in the compressing direction (left direction in FIGS. 1 and 3), the leaf valve 60 closes the air inlet 58 by tightly contacting the front end face of the piston 55. In this manner, leakage of air (into the piston 55) is prevented. When the piston 55 returns (right direction in FIGS. 8 and 9) to the home position, the leaf valve 60 is pressed and opened so that air is introduced in the cylinder 53 (from inside the piston 55). In this manner, air is introduced into the piston 55 in conjunction with the operation of the piston 55. In this embodiment, although an air charging valve, which is the leaf valve 60, is provided on the piston 55 side, the air charging valve may be provided on the cylinder 53 side (end face of a head part of the cylinder, for example) as well.

When the air inside the cylinder 53 is discharged in accordance with the movement of the piston 55 without being accumulated in the cylinder 53 by the movement of the piston 55 in the compressing direction, a discharge pressure of the air cannot be increased and thus the air cannot be rapidly discharged from the piston 55. In the air discharging apparatus of this embodiment, an opening and closing member (shutter member) is provided for the air discharge opening 141 of the cylinder 53 and opened at a predetermined timing (the opening and closing member is closed until the predetermined timing). In this manner, air can be rapidly discharged by increasing the discharge pressure.

Figure 12:
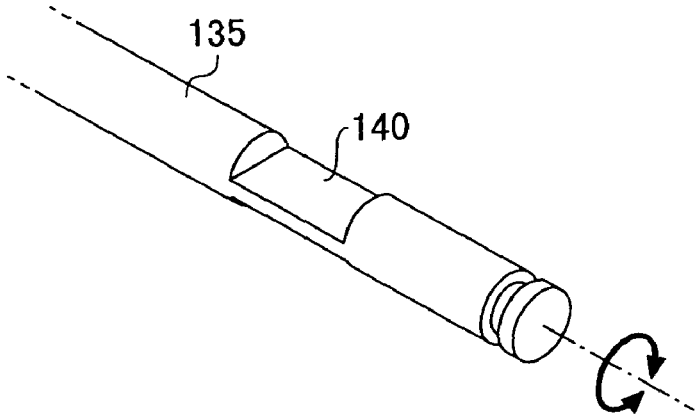
FIG. 12 is a perpendicular view showing a part of an opening and closing member (switching shaft)

As shown in FIG. 3, the boss 143 having the air discharge opening 141 is provided with a through-hole (with a circular cross section in this embodiment) 144 which crosses (vertically in this embodiment) the air discharge opening 141. A switching shaft 135 (opening and closing member) having a cylindrical cross section is inserted in the through-hole 144. The switching shaft 135 is inserted in the through-hole 144 and in a shaft bearing 138 that is fit in a projection 137 provided on a side surface of the air discharging apparatus so as to be rotatably supported. An E-ring is mounted to one end (bottom end in FIG. 3) of the switching shaft 135 while a disc member 134 (and its cylindrical part 134*a*) is fixed to the other end of the switching shaft 135. By providing the E-ring and the disc member 134, the switching shaft 135 is retained so as not to fall out, and a position of the switching shaft 135 in the shaft direction is determined. A flat plate cut part 140 is provided in the switching shaft 135 at a position corresponding to the air discharge opening 141. As shown in FIG. 12, the flat plate cut part 140 is formed by cutting off parts of the circumferential surface of the switching shaft 135 which is in the cylindrical shape. In this embodiment, opposing sides of the flat plate part are cut off in the same shapes so that the flat plate cut part 140 is formed as a flat surface passing through a shaft center of the switching shaft 135 (flat plate that is flat in a direction of a diameter of the switching shaft 135). When the flat plate cut part 140 is at a vertical direction as shown in FIG. 3, the flat plate cut part 140 closes the air discharge opening 141. Thus, air in the cylinder 53 cannot be discharged from the air discharge opening 141. When the flat plate cut part 140 is at a horizontal direction as shown in FIG. 12, the air discharge opening 141 is opened. Thus, the air in the cylinder 53 can be discharged from the discharge opening 141 through both sides of the flat plate cut part 140.

In this embodiment, the switching shaft 135 is rotated 90° to turn the flat plate cut part 140 between the vertical and horizontal directions. In this manner, opening and closing of the air discharge opening 141 are switched. Further, by a mechanism described below, the opening and closing of the air discharge opening 141 (that is, rotation of the switching shaft 135 by 90°) are switched at a predetermined timing. In this manner, the air discharge opening 141 is closed until the predetermined timing so that the pressure in the cylinder 53 is increased to discharge air rapidly.

Figure 13:
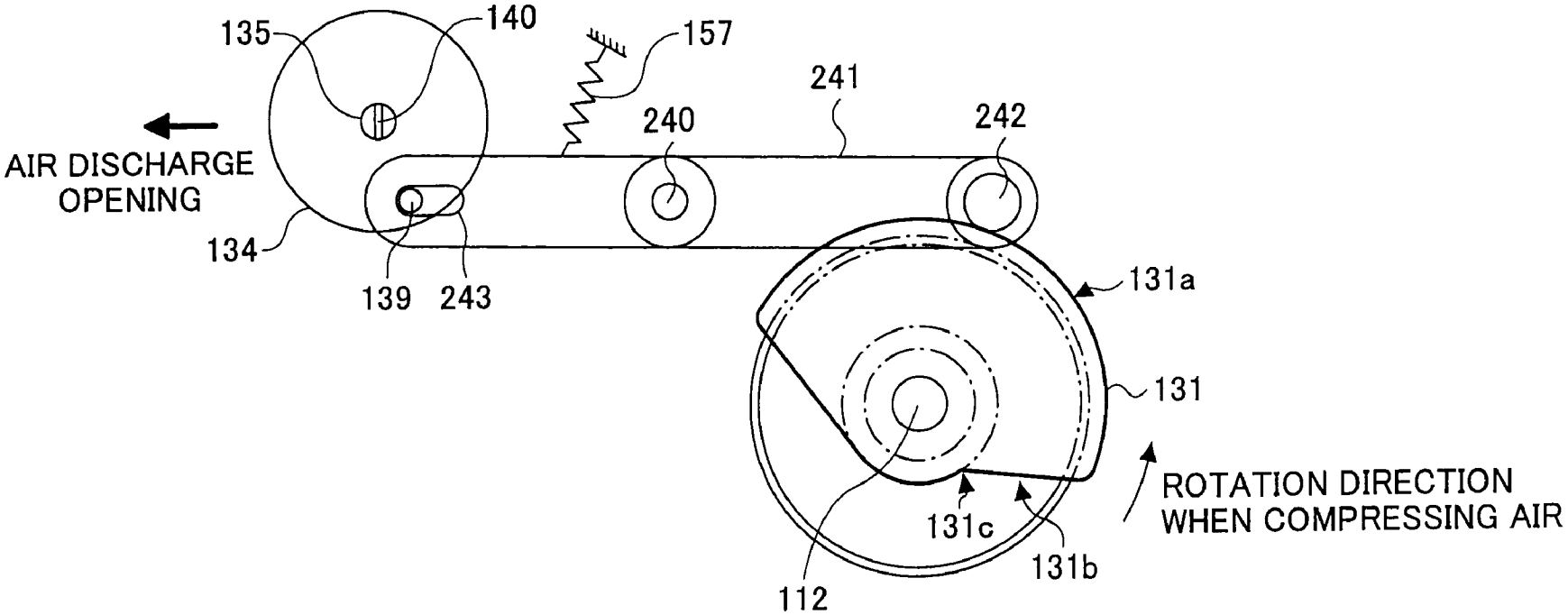
FIG. 13 is a front view showing a state of a switching mechanism when a piston is at a home position.

As shown in FIG. 4, a cam plate 131 is fixed to a back end part of the driving shaft 112. The cam plate 131 is in a sector shape and has an outer circumferential circular part 131*a* and a linear part 131*b* as shown in FIG. 13. A connection between the outer circumferential circular part 131*a* and the linear part 131*b* is formed in a rounded shape so that a cam follower (roller 242) described below moves smoothly.

Further, as shown in FIG. 4, a shaft 240 is fixed in a protruding manner to an outer side surface of the back side board 51. A link lever 241 is rotatably supported by the shaft 240. The link lever 241 is a member in a long and thin plate shape, as shown in FIG. 13. The roller 242 serving as the cam follower is pivotally supported at one end part of the link lever 241. A long hole 243 is formed in the other end part of the link lever 241. An engaging pin 139 provided in a protruding manner on an end surface of the disc member 134 that is fixed to one end of the switching shaft 135 is freely fit in the long hole 243.

An extension spring 157 is provided between the link lever 241 and the apparatus housing. The extension spring 157 biases the link lever 241 so as to press the roller 242 onto the circumferential surface of the cam plate 131. Accordingly, the roller 242 moves in accordance with the rotation of the cam plate 131, and then the link lever 241 is oscillated. By the oscillation of the link lever 241, the disc member 134 is rotated by a predetermined range (angle) via the engaging pin 139. In this embodiment, the above-described cam mechanism is configured so that the rotation range (angle) of the disc member 134 is 90°.

FIG. 13 shows a state that the piston 55 of the air discharging apparatus is at the home position. In this case, the link lever 241 is substantially in a horizontal state, and the flat plate cut part 140 provided in the switching shaft 135 is at the vertical direction, closing the air discharge opening 141 (the state shown in FIG. 3). In this state, when the driving shaft 112 rotates counterclockwise in FIG. 13, the piston 55 moves in the compressing direction. Thus, the cam plate 131 rotates counterclockwise from the state shown in FIG. 13. In a range while the outer circumferential circular part 131*a* slides on the roller 242 (until the roller 242 comes to a position shown in FIG. 14), the position of the roller 242 serving as the cam follower does not change. Therefore, the link lever 241 does not move and the disc member 134 is not rotated either. As a result, the air discharge opening 141 is kept closed. Consequently, a pressure in the cylinder 53 is increased in accordance with the movement of the piston 55.

Figure 14:
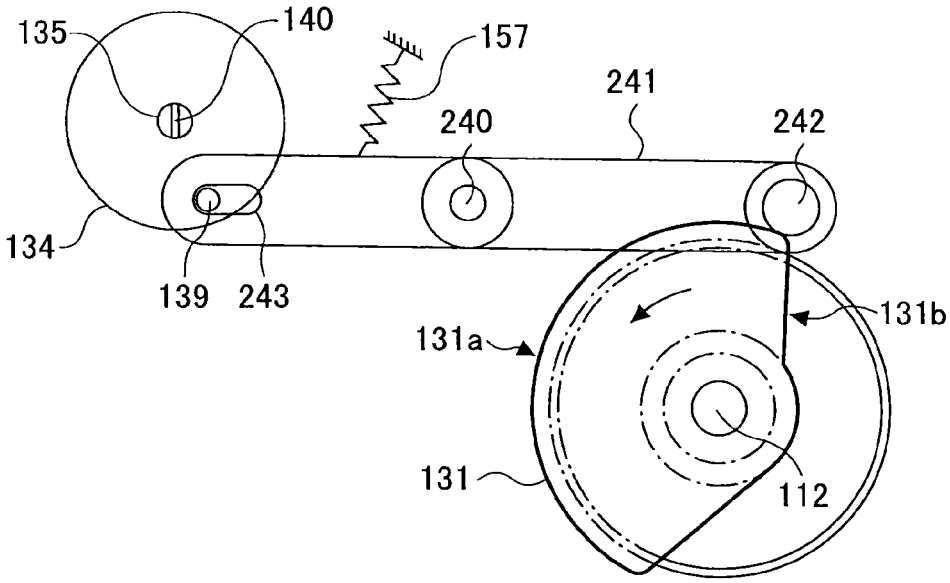
FIG. 14 is a front view showing a state of a switching mechanism when a piston is moving (air discharge opening is closed)
Figure 15:
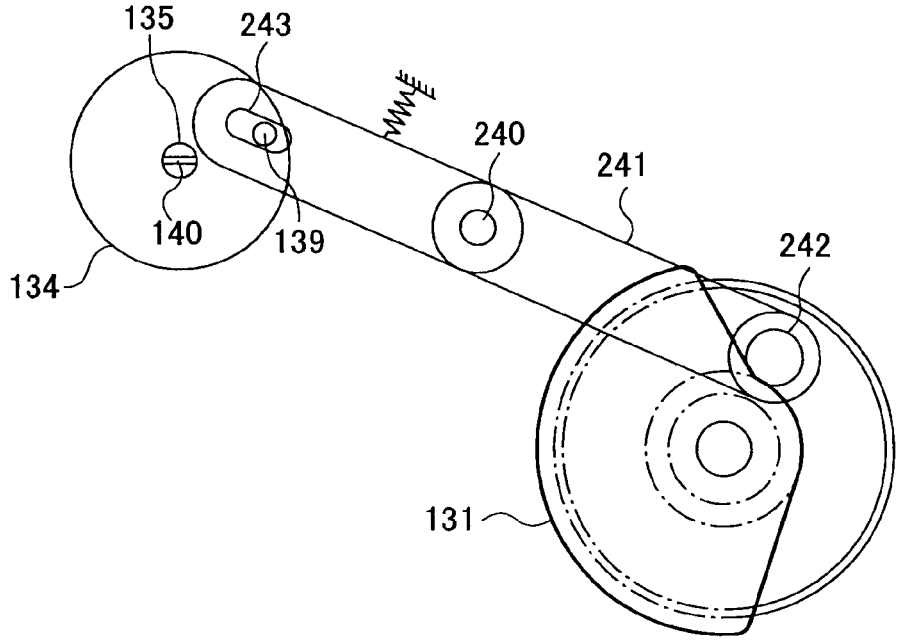
FIG. 15 is a front view showing a state of a switching mechanism when a piston is at a top dead point.

Next, when the cam plate 131 further rotates from the position shown in FIG. 14 and the roller 242 leaves the outer circumferential circular part 131*a* (the roller 242 contacts and slides on the linear part 131*b*), the link lever 241 is rotated clockwise by a biasing force of the spring 157. Then, the engaging pin 139 in the long hole 243 is pushed and rotates the disc member 134 counterclockwise in FIG. 14. Accordingly, the switching shaft 135 (and the flat plate cut part 140) is rotated, and the air discharge opening 141 is opened as shown in FIG. 15. A rotation angle of the cam plate 131, which occurs when the roller 242 leaves the outer circumferential circular part 131*a* and reaches an inner end part 131*c* of the linear part 131*b*, corresponds to a slight distance of movement for the piston 55. Therefore, the air discharge opening 141 changes from the closed state to the open state in a very short time. As a result, the increased pressure of air in the cylinder is rapidly released and a burst of the air is discharged from the air discharge opening 141.

In this embodiment, the rotation angle of the cam plate 131 required for the reciprocating movement of the piston 55 is about 126°. The air discharge opening 141 starts opening when the cam plate 131 rotates by about 92° (about ¾ of the rotation range (angle)) from the home position (position in FIG. 13). While the cam plate 131 rotates by about the remaining 34° (about ¼ of the rotation range (angle)), the air discharge opening 141 is completely opened.

FIG. 15 shows a state that the piston 55 reaches a maximum compressing position (top dead point). The cam plate 131 does not further rotate counterclockwise from the state shown in FIG. 15. While the piston 55 returns from the maximum compressing position to the home position, the cam plate 131 rotates clockwise in FIG. 15 (that is, reversely to the compressing step). When the cam plate 131 reversely rotates, the roller 242 is pushed up by the linear part 131*b* of the cam plate 131, and the link lever 241 is rotated counterclockwise in FIG. 15. As a result, the disc member 134 rotates clockwise to close the air discharge opening 141. After the air discharge opening 141 is closed, in a range while the outer circumferential circular part 131*a* slides on the roller 242 (a range from FIGS. 14 to 13), the air discharge opening 141 is kept closed.

In this manner, in the air discharging apparatus of the present invention, the opening and closing member mechanically coupled to the piston is provided at the air discharge opening. The opening and closing member (that is, the air discharge opening) is closed until a predetermined timing in the compressing step, and can be opened in a short time around the top dead point. Therefore, the pressure of air can be increased in the cylinder. Further, a burst of the air with the increased pressure can be discharged. A conventional air supply system (air supply apparatus) having a compressor, an air tank, and an electromagnetic valve has been necessarily quite large in size, and an apparatus using the air supply system has been limited to a large apparatus (for example, a commercial apparatus). However, the air discharging apparatus of the present invention employs a small air pump instead of the compressor of the conventional system, and an opening and closing member mechanically coupled to the piston is provided in the body of the air discharging apparatus incorporating the small air pump. Accordingly, the air tank and electromagnetic valve which have been essential in the conventional system can be omitted. Thus, an apparatus configuration that is quite smaller and lower in cost than the conventional apparatus is realized. Moreover, a noise made by the compressor is not generated. The air discharging apparatus of the present invention has a considerably wider range of applications. That is, the air discharging apparatus of the present invention can be mounted not only in commercial apparatuses but also in various small apparatuses used personally or in offices. In those various apparatuses, discharging of air is realized.

Figure 16:
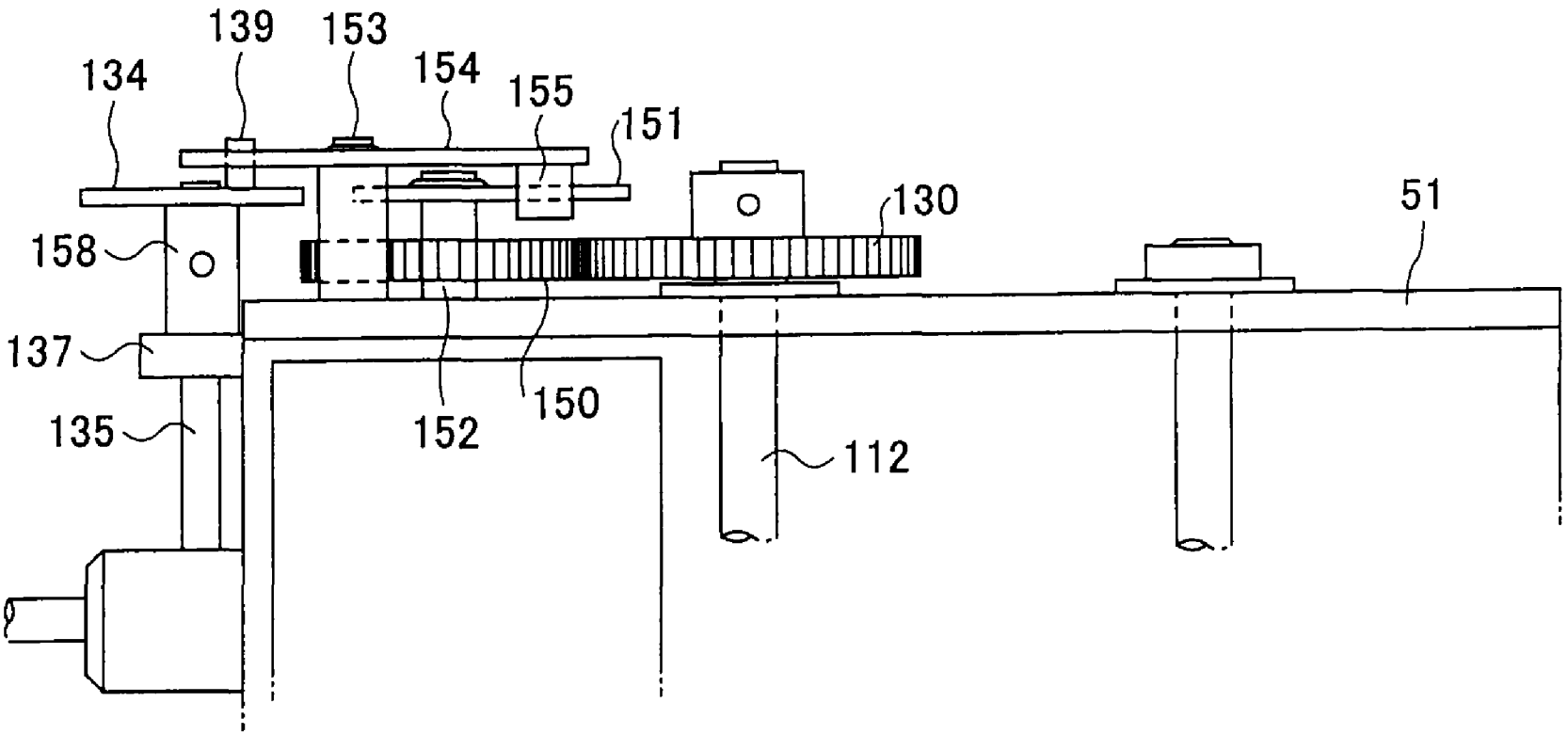
FIG. 16 is a partial plane cross-sectional view of an air discharging apparatus, showing another example of a switching mechanism.
Figure 17:
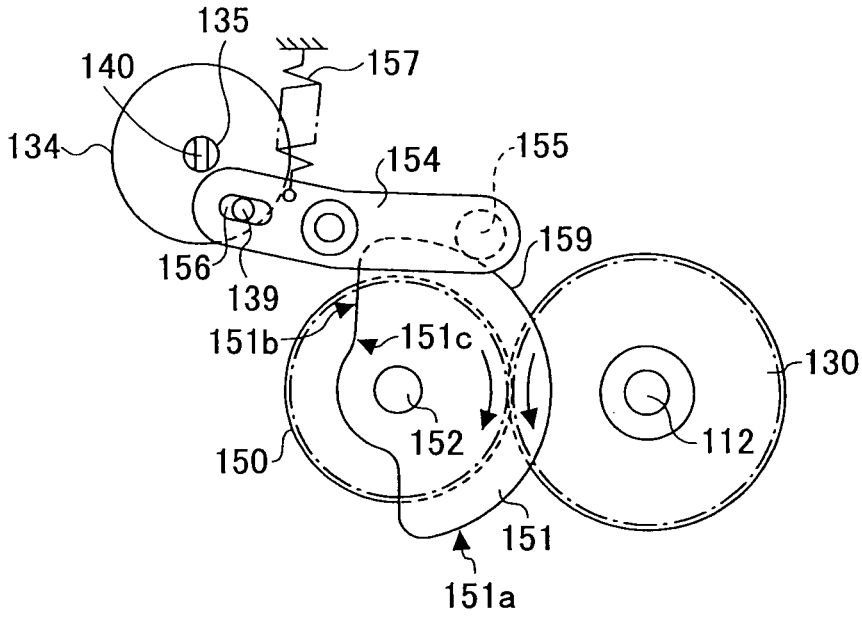
FIG. 17 is a front view showing a state of a switching mechanism when a piston is at a home position.
Figure 18:
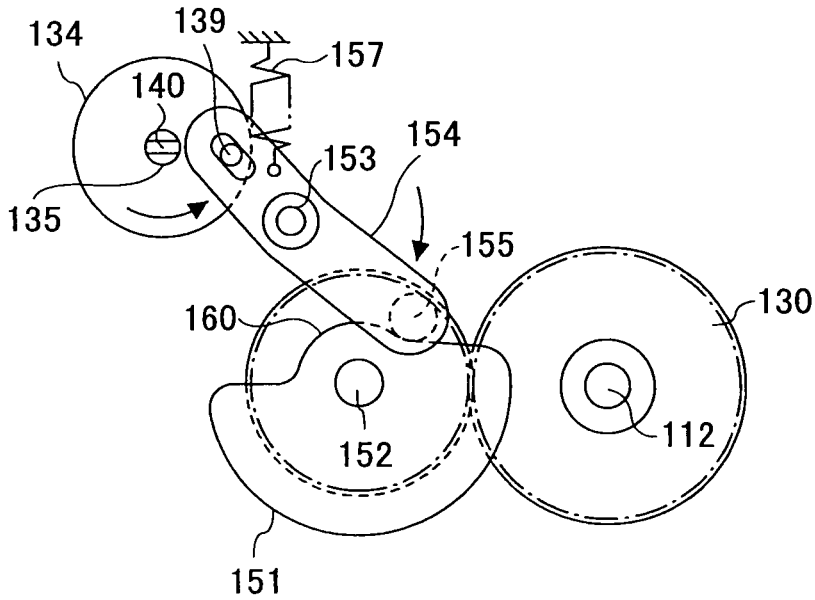
FIG. 18 is a front view showing a state of a switching mechanism when a piston is at a top dead point.

FIGS. 16 to 18 show another example of the switching mechanism for switching opening and closing of the air discharge opening 141 by turning the switching shaft 135. FIGS. 16, 17, and 18 correspond to FIGS. 4, 13, and 15 showing the above-described configurations, respectively. Descriptions of the same parts as those described above are omitted here.

In the configurations shown in FIGS. 16 to 18, a gear 130 is fixed to the driving shaft 112. A coupling gear 150 engaged with the gear 130 is rotatably supported about a shaft 152 which is fixed in a protruding manner on the side surface of the back side board 51. A cam plate 151 is formed in an integrated manner with the coupling gear 150. Further, a link lever 154 is rotatably supported at a shaft 153 fixed in a protruding manner on the side surface of the back side board 51. The link lever 154 is a member in a long and thin plate shape as shown in FIG. 17. A roller 155 serving as a cam follower is pivotally supported at one end part of the link lever 154. A long hole 156 is formed in the other end part of the link lever 154. An engaging pin 139 provided in a protruding manner on an end surface of the disc member 134 that is fixed to one end of the switching shaft 135 is freely fit in the long hole 156. An extension spring 157 is provided between the link lever 154 and the housing of the air discharging apparatus. The extension spring 157 biases the link lever 154 so as to press the roller 155 onto the circumferential surface of the cam plate 151. The roller 155 of the link lever 154 contacts a circumferential surface of the cam plate 151, the roller 155 moves in accordance with the rotation of the cam plate 151, and then the link lever 154 is oscillated. By the oscillation of the link lever 154, the disc member 134 is rotated by a predetermined range (angle) via the engaging pin 139. In this embodiment, the above-described cam mechanism is configured so that the rotation range (angle) of the disc member 134 is 90°.

FIG. 17 shows a state in which the piston 55 of the air discharging apparatus is at the home position. In this case, the flat plate cut part 140 provided in the switching shaft 135 is in the vertical direction, closing the air discharge opening 141 (the state shown in FIG. 3). In this state, when the driving shaft 112 rotates counterclockwise in FIG. 17, the piston 55 moves in the compressing direction. Thus, the gear 130 rotates counterclockwise, thereby the coupling gear 150 and the cam plate 151 rotate clockwise. When the roller 155 leaves the outer circumferential circular part 151*a* of the cam plate 151 and moves onto a linear part 151*b* in accordance with the rotation of the cam plate 151, the link lever 154 is rotated clockwise by a biasing force of the spring 157. Accordingly, the disc member 134 rotates counterclockwise in FIG. 17. As a result, the switching shaft 135 (and the flat plate cut part 140 thereof) rotates to open the air discharge opening 141 as shown in FIG. 18.

FIG. 18 shows a state in which the piston 55 reaches a maximum compressing position (top dead point). In FIG. 18, the roller 155 serving as the cam follower has reached an inner end part 151*c* (FIG. 17) of the linear part 151*b*. The cam plate 151 does not further rotate clockwise from the state shown in FIG. 18. While the piston 55 returns from the maximum compressing position to the home position, the cam plate 151 rotates counterclockwise in FIG. 18 (that is, reversely to the compressing step). When the cam plate 151 reversely rotates, the roller 155 is pushed up by the linear part 151*b* of the cam plate 151, and the link lever 154 is rotated counterclockwise in FIG. 18. As a result, the disc member 134 rotates clockwise in FIG. 18 to close the air discharge opening 141. After the air discharge opening 141 is closed, in a range while the outer circumferential circular part 151*a* slides on the roller 155, the air discharge opening 141 is kept closed.

In the configurations shown in FIGS. 16 to 18, the opening and closing member (that is, the air discharge opening) mechanically coupled to the piston is closed until a predetermined timing in the compressing step, and can be opened in a short time around the top dead point. Therefore, the pressure of air can be increased in the cylinder. Further, a burst of the air with the increased pressure can be discharged.

By changing relative positions of the piston 55 and the cam plates 131 and 151, the timing to discharge air (timing to open the air discharge opening 141) can be changed. Moreover, by changing the shape of the cam plates 131 and 151, the pressure of air and the timing to discharge air can be changed as well. Further, a time to keep the air discharge opening 141 open (opening duration time) can be also changed. A waveform of discharged air (pressure characteristics) can be changed by a simple method. The air discharging apparatus can be easily optimized according to applications.

Figure 19B:
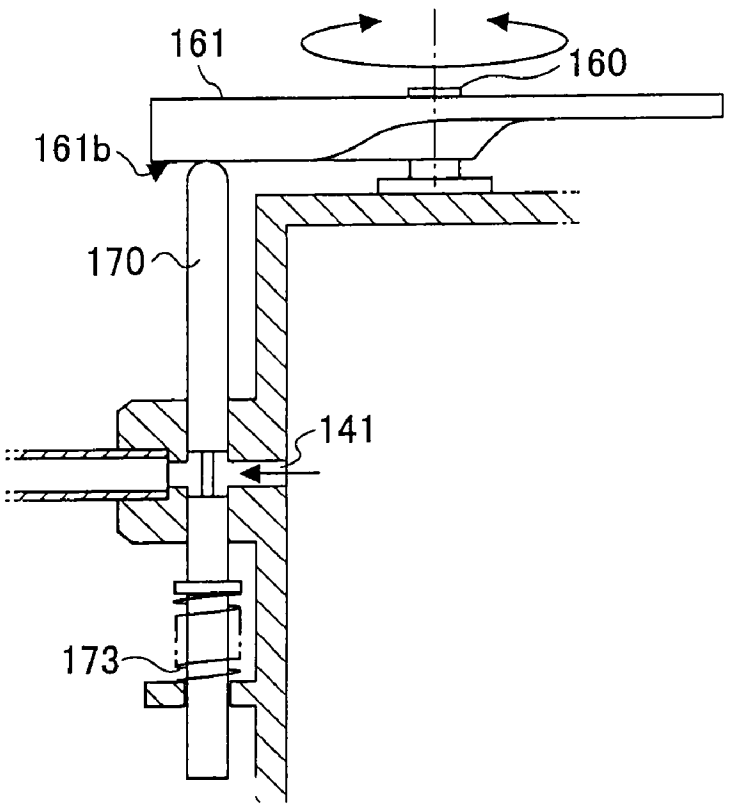
FIGS. 19A and 19B are partial plane cross-sectional views of an air discharging apparatus, showing another example of an opening and closing member.
Figure 19A:
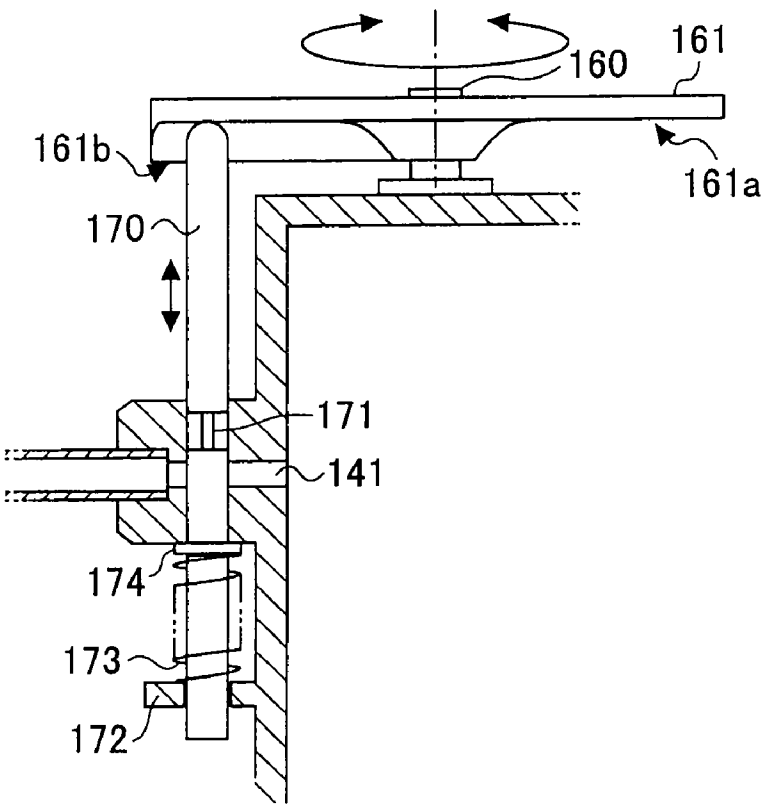
Figure 20:
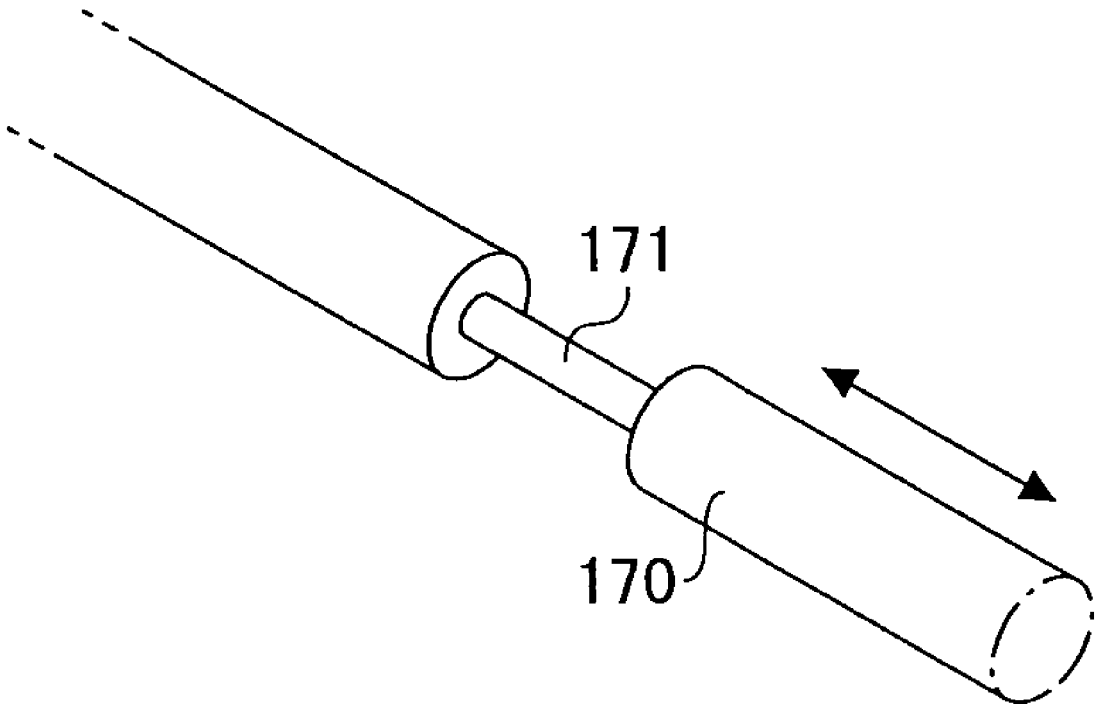
FIG. 20 is a perpendicular view showing a part of an opening and closing member (sliding member)

FIGS. 19 and 20 show another example of the opening and closing member for opening and closing the air discharge opening 141. In this example, a switching member 170 (opening and closing member) is used instead of the switching shaft 135. The switching member 170 of this example is provided as a shaft member in a cylindrical shape which is similar to the switching shaft 135. In this configuration example where the switching member 170 is slid in a longitudinal direction, the switching member 170 is not necessarily a cylindrical member. For example, the switching member 170 may be a prismatic member (a member having a cross section in a polygonal shape). The switching member 170 includes a small volume part (a small diameter part in this example) 171 as a configuration corresponding to the flat plate cut part 140 of the switching shaft 135. As shown in FIGS. 19A and 19B, by sliding the switching member 170 in the shaft direction (longitudinal direction), opening and closing of the air discharge opening 141 are switched. As a configuration to slide the switching member 170, an end face cam (bell cam) 161 as a kind of a solid cam is used. The end face cam 161 is a disc-shaped member rotatably supported about a shaft 160. The end face cam 161 has a thin plate part 161*a* with a small thickness and a thick plate part 161*b* with a large thickness, which are connected by a smooth curved surface. The end face cam 161 is rotated at a predetermined timing by a mechanism as described with reference to FIGS. 13 and 15 or 17 and 18. A disc member 174 is fixed to the switching member 170. A compressing spring 173 is fit about the switching member 170 between the disc member 174 and a boss 172 provided on the body side of the piston 55.

As shown in FIG. 19A, when a front end of the switching member 170 contacts the thin plate part 161*a* of the end face cam 161, the switching member 170 is pushed up by a biasing force of the spring 173. Since the small diameter part 171 is out of the air discharge opening 141 in this state, the air discharge opening 141 is closed. When the end face cam 161 rotates and the thick plate part 161*b* moves to contact the switching member 170, the spring 173 is compressed and the switching member 170 moves downward as shown in FIG. 19B. Then, the small diameter part 171 moves to a position of the air discharge opening 141, thereby the air discharge opening 141 is opened. When the end face cam 161 rotates and the thin plate part 161*a* moves to contact the switching member 170 again, the air discharge opening 141 is closed again.

The air discharge apparatus of this example employs the stepping motor as the driving source, as described above. By controlling the stepping motor 110 differently, the distance of movement of the piston 55 can be easily changed. By changing the distance of movement (stroke) of the piston 55, a discharge amount and pressure of the air pump can be changed. In the actual control, rotations (the number of steps) of the stepping motor 110 are counted by using the home position as a reference. By changing the number of steps, the stroke of the piston 55 can be extended (the pressure and discharge amount are increased) or shortened (the pressure and discharge amount are decreased).

By changing a rotation speed of the stepping motor 110, the pressure of air can be changed as well. Further, by starting the stepping motor 110 slowly in the initial stage of rotation (initial stage of the movement of the piston 55 from the home position) so as to reduce a driving torque, and speeding up the rotation speed in a predetermined stage of the compressing step, a low torque driving can be performed with the same cycle as a normal driving (with the constant rotation speed).

In the air discharging apparatus 500 of this example, a low friction material is used as a material of the cylinder 53 and the piston 55. Since a fluorine resin is expensive, a resin formed by adding fluorine powder to a low friction material such as a polyacetal resin may be used as well. Accordingly, a slipping property and abrasion resistance can be improved and durability of the cylinder 53 and the piston 55 can be extended.

Next, a second embodiment of an air discharging apparatus is described.

In the above-described air discharging apparatus of the first embodiment, the piston 55 is driven by linearly moving (reciprocating) the guiding shaft 70. In the second embodiment, the piston 55 is driven by using a crank mechanism. Since a major configuration of the air pump is the same as the first embodiment, different points between the first and second embodiments are mainly described below.

Figure 21:
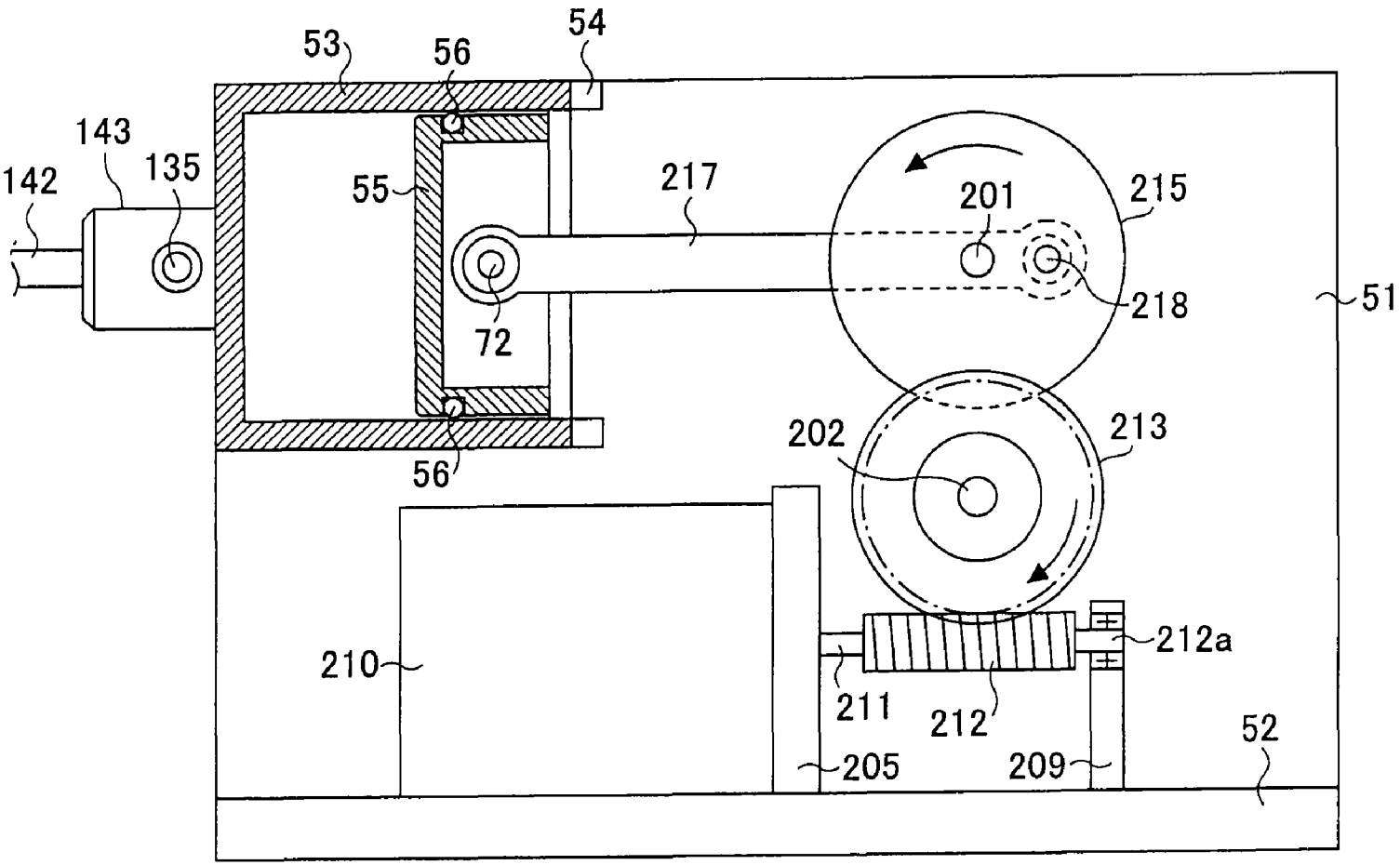
FIG. 21 is a vertical cross-sectional view of an air discharging apparatus of a second embodiment, seen in a direction from a front.
Figure 22:
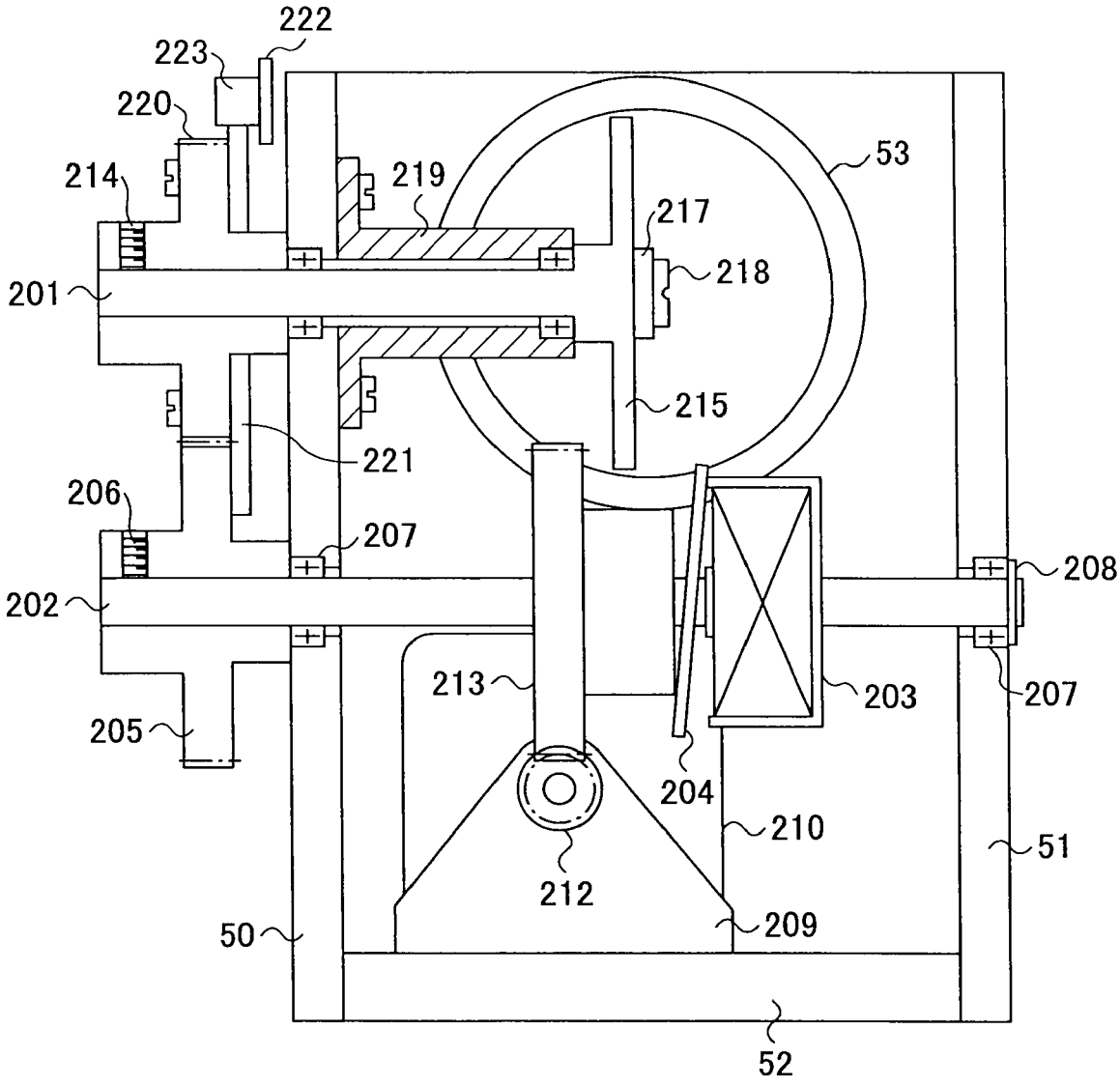
FIG. 22 is a vertical cross-sectional view of an air discharging apparatus of a second embodiment, seen in a direction from a side surface.
Figure 23:
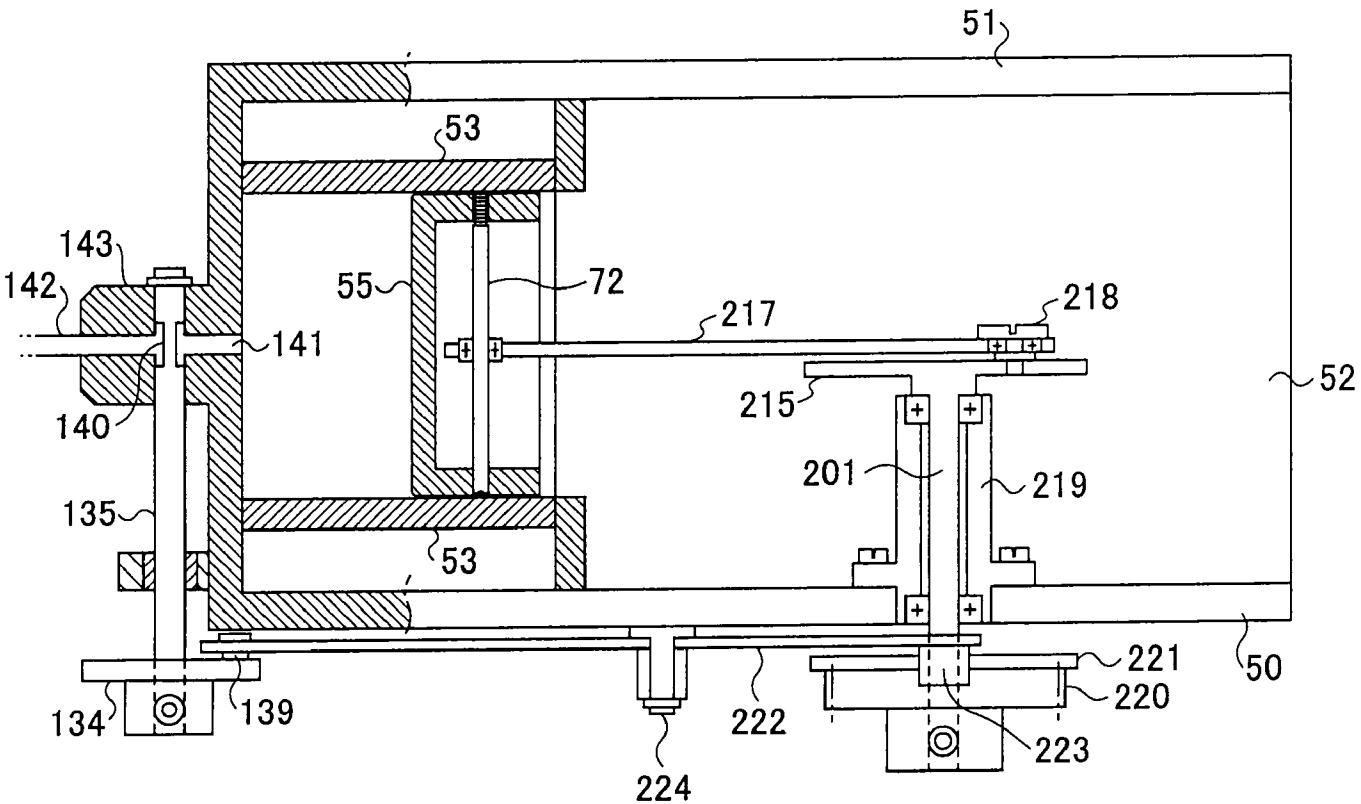
FIG. 23 is a plane cross-sectional view of an air discharging apparatus of a second embodiment.
Figure 24:
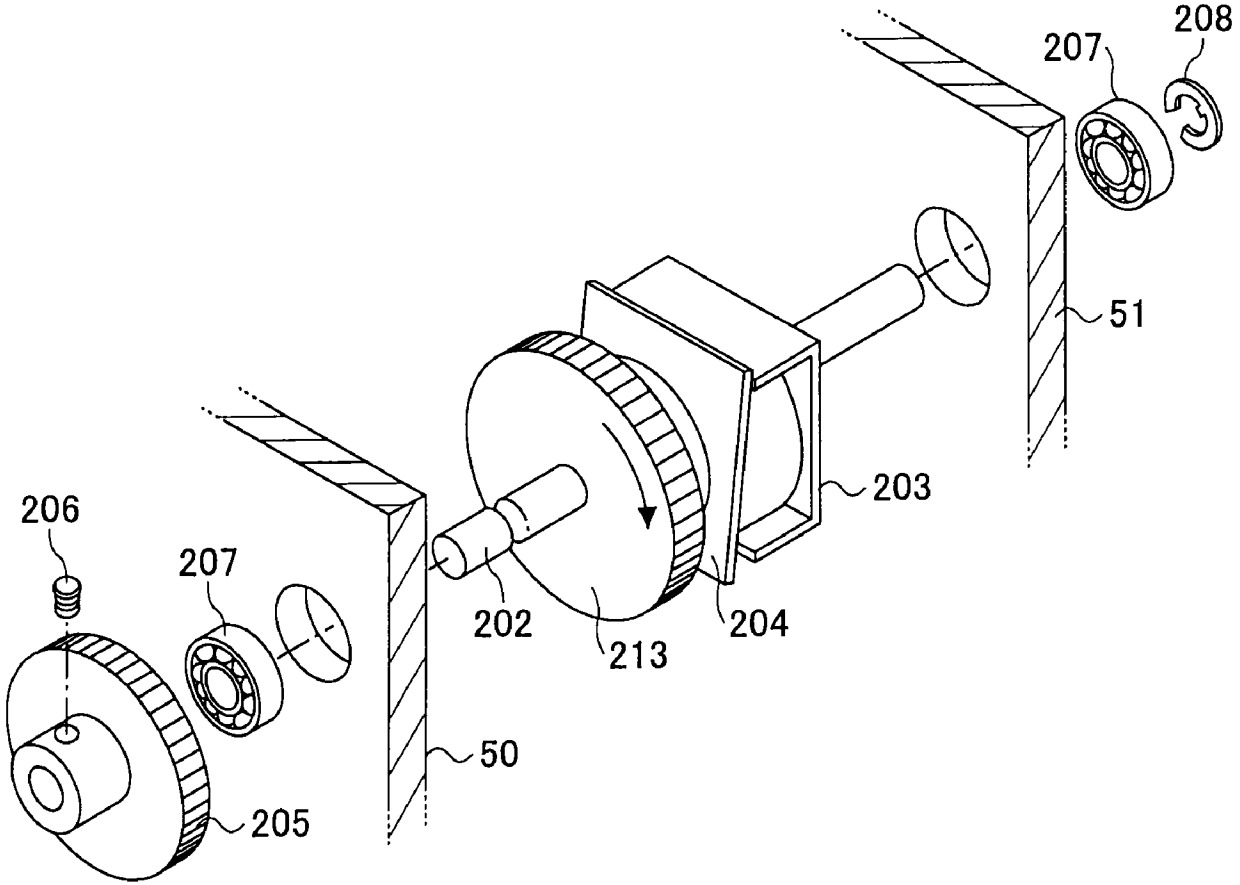
FIG. 24 is a perpendicular view showing a configuration of a vicinity of a clutch shaft in an air discharging apparatus.
Figure 25:
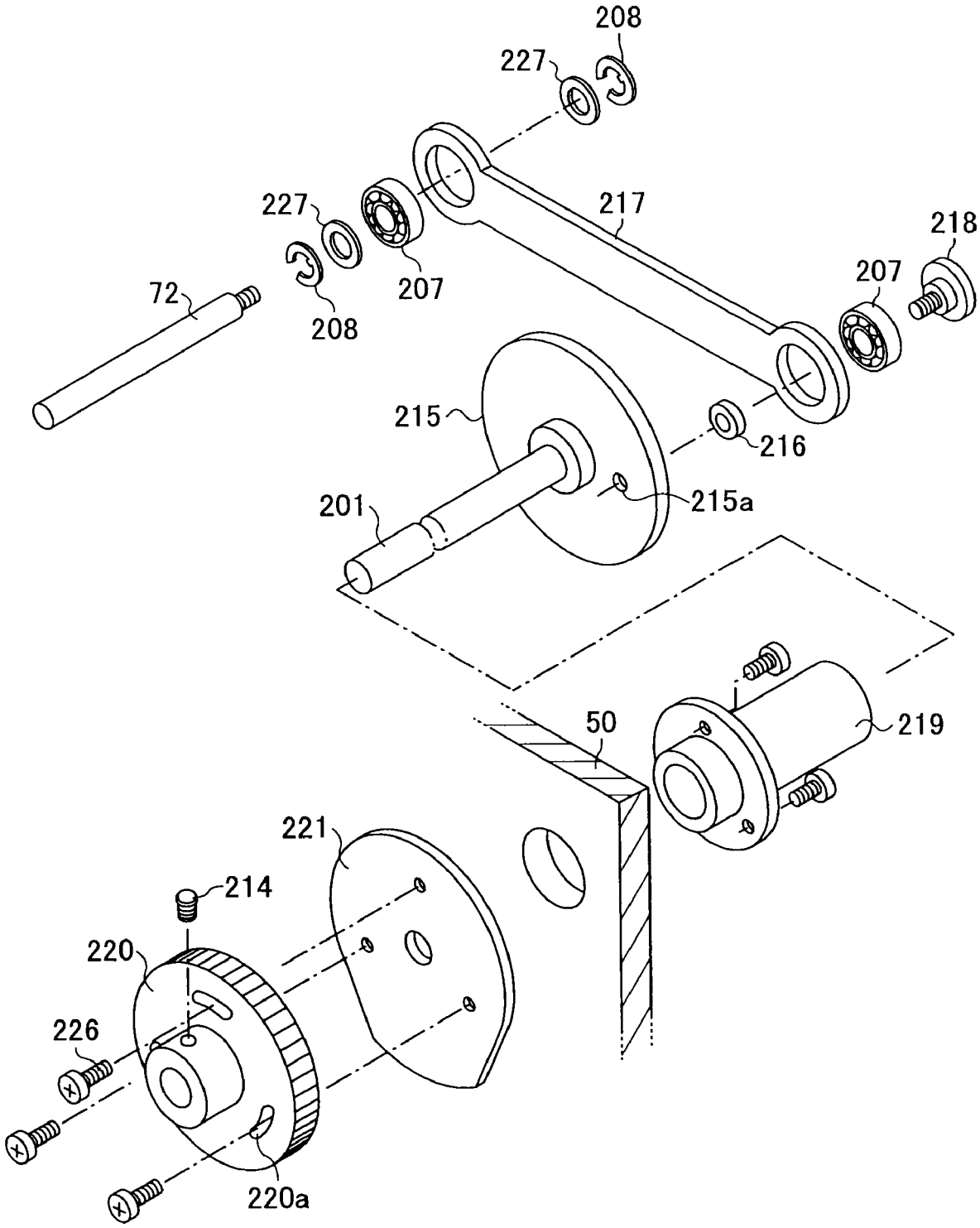
FIG. 25 is a perpendicular view showing a configuration of a vicinity of a crank shaft in an air discharging apparatus.

FIG. 21 is a vertical cross-sectional view of an air discharging apparatus of the second embodiment, seen in a direction from a front. FIG. 22 is a vertical cross-sectional view of the air discharging apparatus seen in a direction from a side surface (a side surface opposite to the air discharging opening 141), which is a direction from a right in FIG. 21. FIG. 23 is a plane cross-sectional view of the air discharging apparatus of the second embodiment. FIG. 24 is a perpendicular view showing a configuration in the vicinity of a clutch shaft. FIG. 25 is a perpendicular view showing a configuration in the vicinity of a crank shaft.

As shown in these drawings, the cylinder 53 is supported between the front and back side boards 50 and 51, and the piston 55 provided in the cylinder 53 reciprocates in left and right directions in FIG. 21, in a similar manner to the air discharging apparatus of the first embodiment. The boss 143 is provided in a protruding manner on the front end surface of the cylinder 53. The air discharge opening 141 is provided in the boss 143. Air in the cylinder 53, which is compressed by the movement of the piston 55, is discharged outside from the air discharge opening 141 through the tube 142, as described above.

In FIG. 21, a motor 210 is attached to a motor bracket 205 provided in a protruding manner on the bottom board 52. A DC servomotor is used as the motor 210 in this embodiment. A worm 212 is pressed and coupled to an output shaft 211 of the motor 210. A front end part 212*a* of the worm 212 is supported, through a shaft bearing, at a holder 209 provided facing the motor bracket 205. When the worm 212 rotates, a downward bending force is applied to the worm 212 by a reaction of a worm wheel 213. Therefore, the front end part of the worm 212 is supported by the holder 209. The worm wheel 213 is engaged with the worm 212. When the motor 210 is driven, the worm wheel 213 is rotated by the worm 212. When a spring clutch 203 described below is disengaged (declutched), a shaft 202 does not rotate. When the spring clutch 203 is engaged (clutched), the shaft 202 rotates.

On the contrary to the worm, a gear having a depression in a central part is normally used as the worm wheel, however, a helical gear is used as the worm wheel in this embodiment. Further, by using a worm gear (worm and worm wheel), a speed reducing ratio can be set large and a torque can be improved.

As shown in FIGS. 22 and 24, the shaft 202 is supported between the front and back boards 50 and 51 through shaft bearings 207. The spring clutch 203, which is a one-rotation clutch, is mounted to the shaft 202. The worm wheel 213 is couplably and releasably mounted to the shaft 202 (referred to as a clutch shaft, hereinafter). That is, when the spring clutch 203 is energized, an armature 204 is absorbed. Then, an internal claw (not shown) is disengaged and the worm wheel 213 and the clutch shaft 202 are engaged. As a result, the clutch shaft 202 rotates (when the motor 210 is driven). When the clutch shaft 202 rotates once and comes back to the position of the internal claw again, the internal claw spreads the spring of the spring clutch 203. Then, the engagement between the clutch shaft 202 and the worm wheel 213 is released (disengaged), and the worm wheel 213 idles (the clutch shaft 202 does not rotate). A time to energize the spring clutch 203, which is for disengaging the internal claw, is about 100 ms in this embodiment.

A clutch gear 205 is mounted and fixed to a front end part of the clutch shaft 202 by a fixing screw 206. Therefore, when the clutch shaft 202 rotates, the clutch gear 205 also rotates. A crank shaft 201 provided above the clutch shaft 202 is supported to be parallel to the clutch shaft 202. The crank shaft 201 is rotatably supported by the front side board 50 and a sleeve 219 fixed on the front side board 50, through a shaft bearing.

As shown in FIGS. 22 and 25, the crank gear 220 is mounted and fixed to a front end part of the crank shaft 201 by a fixing screw 214. A crank plate 215 is mounted and fixed to an opposite side (back side) of the crank shaft 201. The crank plate 215 may be formed in an integrated manner with the crank shaft 201. The crank plate 215 has a screw hole 215*a*. Through the screw hole 215*a*, a crank lever 217 is coupled to the crank plate 215 through a bearing 207 and a collar 216 by a screw 218.

As shown in FIG. 25, a rod 72 is fit in the other end of the crank lever 217 through the bearing 207. The rod 72 is further retained so as not to fall out, by E-rings 208 and spacers 227. The rod 72 is coupled to the piston 55 (see FIG. 23). In this manner, the piston 55 is mounted, via the rod 72, to the front end part of the crank lever 217 rotatably attached to the crank plate 215. Therefore, in FIG. 21, when the crank plate 215 rotates about the crank shaft 201, the crank lever 217, which is attached to the crank shaft 201 with eccentricity, cranks. By this cranking movement, the piston 55 reciprocates in the cylinder 53.

Figure 26:
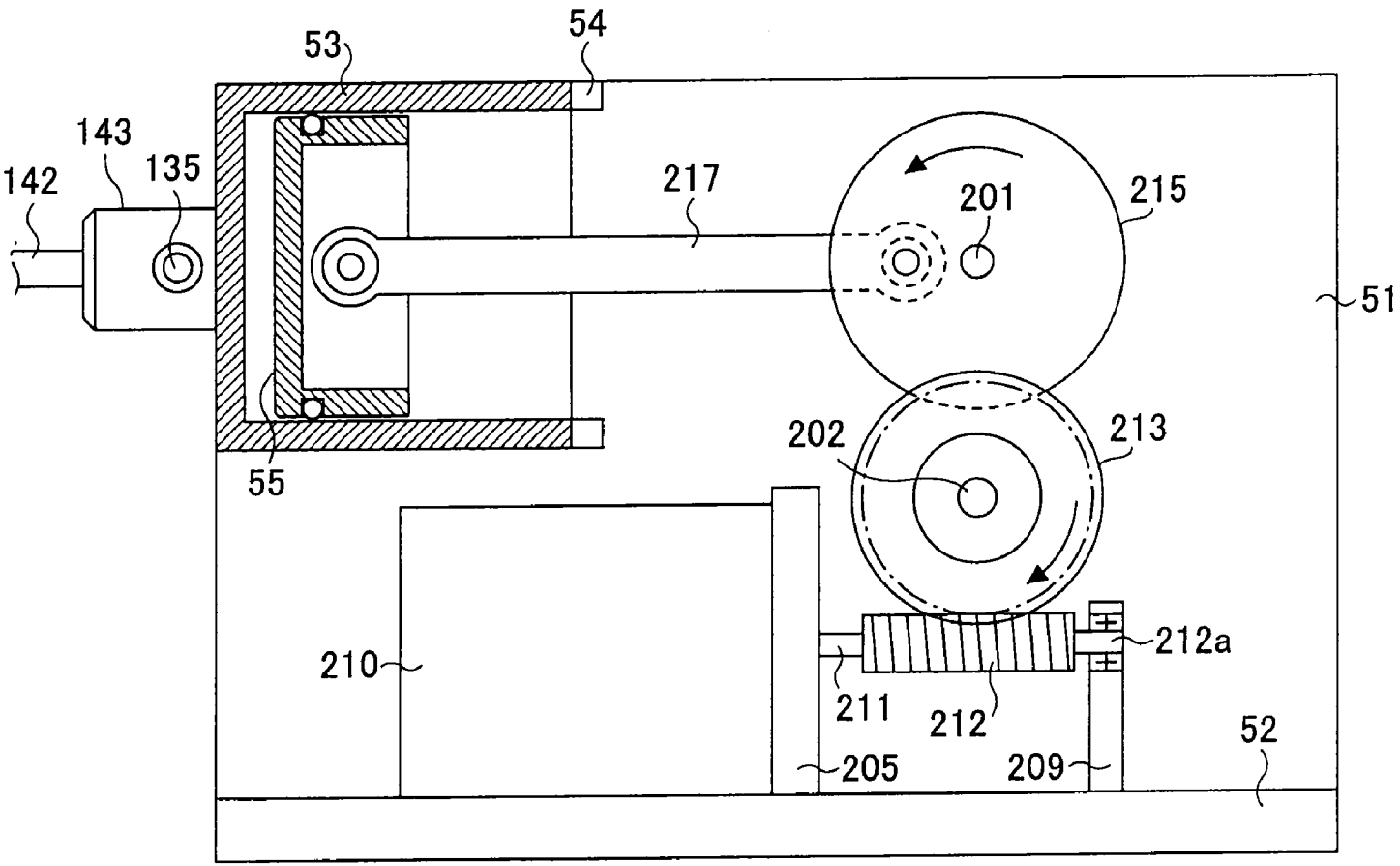
FIG. 26 is a vertical cross-sectional view showing a state in which a piston has moved to a compressing position (top dead point)

When a crank gear 220 (FIGS. 22 and 25) mounted to the front end part of the crank shaft 201 rotates once, the crank lever 217 rotates once, and the piston 55 reciprocates once. FIGS. 21 and 23 show states in which the piston 55 is at the home position. FIG. 26 shows a state in which the piston 55 is at the top dead point (a compressing position where the cylinder volume is minimum).

In accordance with the cranking movement, the crank lever 217 passes by in front of the rear end of the crank shaft 201. Therefore, the crank shaft 201 cannot be supported at the front and back side boards 50 and 51. In this embodiment, the crank shaft 201 is supported by the front side board 50 like a cantilever, by using the sleeve 219. In this configuration, the sleeve 219 allows a length between the front and back bearings (FIG. 22) supporting the crank shaft 201 to be extended and stably supports the crank shaft 201.

As shown in FIG. 25, the crank gear 220 has plural (three in this embodiment) long holes 220*a*. A cam plate 221 is fixed to the crank gear 220 by screws 226 through the long holes 220*a*. By forming the long holes for the screws to be fixed, a position of the cam plate 221 can be changed. Accordingly, a timing to discharge air can be changed.

Figure 27:
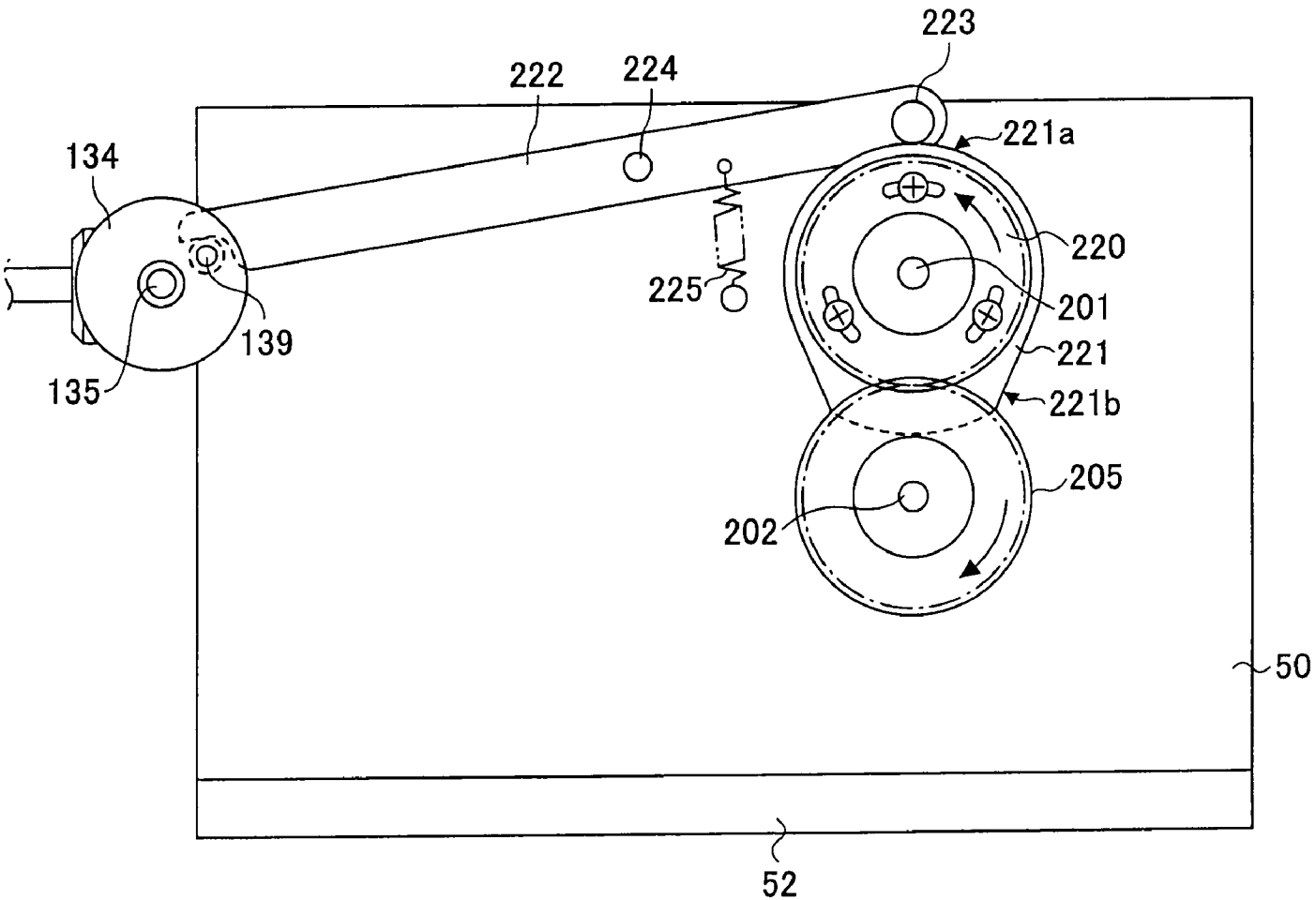
FIG. 27 is a front view showing a state of a switching mechanism when a piston is at a home position.
Figure 28:
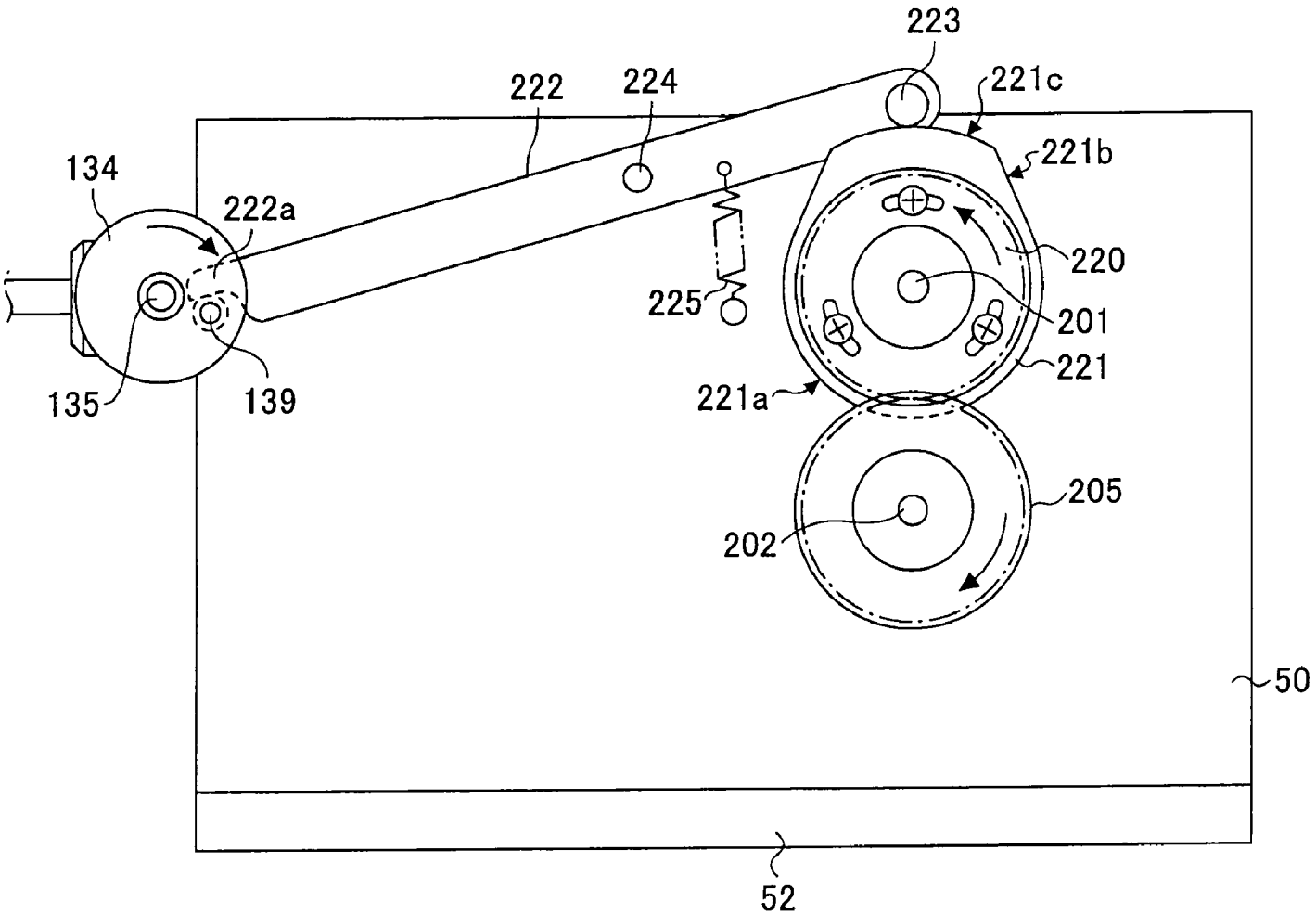
FIG. 28 is a front view showing a state of a switching mechanism when a piston is at a top dead point.

As shown in FIGS. 27 and 28, a link lever 222 is rotatably (rockably) supported by a shaft 204 outside (front side) the front side board 50. A roller 223 serving as a cam follower is pivotally supported at one end part of the link lever 222, which is a member in a long and thin plate shape. A biasing force in a clockwise direction in FIGS. 27 and 28 is applied to the link lever 222 by a coil spring 225 serving as a biasing member having one end part locked at the front side board 50. Accordingly, the roller 223 serving as the cam follower is contacted onto an end face of the cam plate 221.

In the above-described configuration, when the clutch shaft 202 rotates and the clutch gear 205 rotates clockwise in FIGS. 27 and 28, the crank gear 220 engaged with the clutch gear 205 and the cam plate 221 fixed to the crank gear 220 rotate counterclockwise in FIGS. 27 and 28. In accordance with the movement of the cam plate 221, the roller 223 rolls contacting the end face of the cam plate 221, and the link lever 222 oscillates about the shaft 224.

As shown in FIG. 23, the disc member 134 is fixed to an end part of the switching shaft 135, which is provided passing through the boss 143 and switches opening and closing of the air discharge opening 141. The engaging pin 139 is provided in a protruding manner on an end surface of the disc member 134. In FIGS. 27 and 28, an engaging part 222*a* to be engaged with the engaging pin 139 is formed in the other end part of the link lever 222. The engaging part 222*a* is engaged with the engaging pin 139.

FIG. 27 shows a state in which the piston 55 is at the home position. In this case, the roller 223 serving as the cam follower contacts a small diameter circular part 221*a* of the cam plate 221. In this state, the engaging pin 139 of the disc member 134 is at an angle of diagonally up and right in FIG. 27. In this state, the air discharge opening 141 is closed. In a range while the cam plate 221 rotates by a predetermined angle, the roller 223 slides on the small diameter circular part 221*a* of the cam plate 221 and the air discharge opening 141 is kept closed.

When the roller 223 leaves the small diameter circular part 221*a* of the cam plate 221 and moves to a linear part 221*b*, the roller 223 is gradually pushed up and the link lever 222 rotates counterclockwise in FIG. 27. Accordingly, the engaging part 222*a* at the front end of the link lever 222 gradually moves downward, pushing down the engaging pin 139 which rotates the disc member 134 clockwise in FIG. 27. As shown in FIG. 28, a position of the link lever 222 is at a maximum rotation range when the roller 223 contacts a large diameter circular part 221*c* of the cam plate 221. In this state, the engaging part 222*a* has moved to the lowermost position. At this time, the engaging pin 139 of the disc member 134 is at an angle of diagonally down and right. In this state, the air discharge opening 141 is in a maximum opened state. FIG. 28 shows a state in which the piston 55 is at the top dead point (a compressing position where the cylinder volume is minimum).

When the cam plate 221 rotates from the home position in FIG. 27, the air discharge opening 141 is kept closed in a range while the roller 223 slides on the small diameter circular part 221*a* of the cam plate 221. Therefore, a pressure in the cylinder 53 is increased in accordance with the movement of the piston 55. Although the roller 223 moves to the large diameter circular part 221*c* of the cam plate 221 in accordance with the rotation of the cam plate 221, a rotation angle of the cam plate 221, which occurs when the roller 223 moves from the small diameter circular part 221*a* to the large diameter circular part 221*c*, corresponds to a slight distance of movement for the piston 55. Therefore, the air discharge opening 141 changes from the closed state to the open state in a very short time. Thus, an increased pressure of air in the cylinder is released at a burst and the air is discharged at a high speed from the air discharge opening 141.

When the piston 55 returns from the maximum compressing position to the home position, the cam plate 221 further rotates from the state of FIG. 28 (counterclockwise in FIG. 28). Accordingly, the link lever 222 reversely rotates (clockwise in FIG. 28) and the air discharge opening 141 is closed. At this time, the disc member 134 is rotated counterclockwise by a returning spring in a counterclockwise direction, which is not shown. In a range while the roller 223 slides on the small diameter circular part 221*a* of the cam plate 221, the air discharge opening 141 is kept closed. In this embodiment, the clutch gear 205 and the crank gear 220 have the same number of teeth. When the clutch shaft 202 rotates once, the crank shaft 201 rotates once as well, and the piston 55 reciprocates once.

In the second embodiment, by changing a shape of the cam plate 221, a timing to discharge air can be changed. Moreover, by changing an angle (position in a rotation direction) of the cam plate 221, the timing to discharge air can also be changed. As described above, the cam plate 221 is fixed to the crank gear 220 by using the long holes 220*a*, therefore, it is easy to finely control the angle of the cam plate 221.

Next, an embodiment is described with reference to FIGS. 29 to 32, where the air discharging apparatus of the present invention is applied for paper separation (air separation) in a fixing apparatus of an image forming apparatus.

Figure 29:
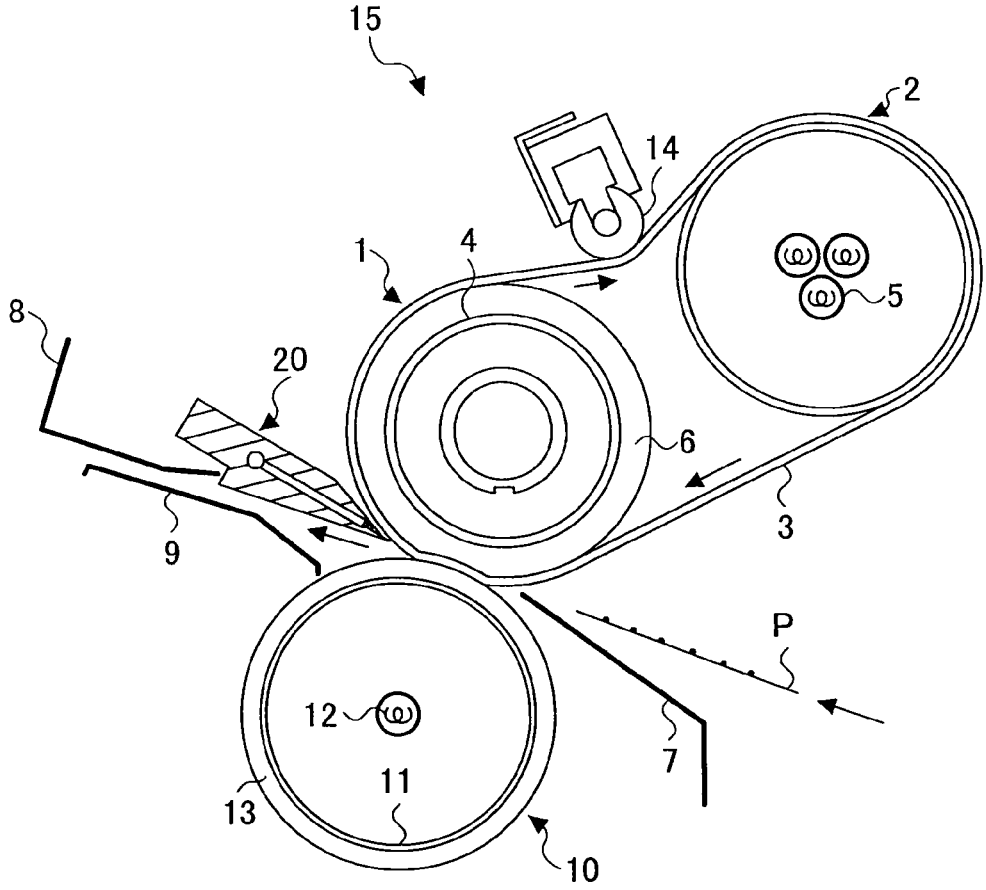
FIG. 29 is a cross-sectional view showing a major configuration of a fixing apparatus to which an air discharging apparatus of the present invention is applied.

A fixing apparatus 15 shown in FIG. 29 as a unit is configured employing a belt fixing method. The belt fixing method aims to reduce heat capacity of a surface to increase the temperature quickly after the apparatus is turned on. The belt fixing method further aims to improve a separation property of paper from a fixing roller and a fixing belt by setting a surface hardness of the fixing roller softer (a rubber layer is formed thicker) than a surface hardness of the pressure roller, and paper comes downward out of a nip part between the fixing roller and the pressure roller. When a separation property of a paper separating unit is sufficiently high as in this example, the fixing roller and the pressure roller may have equal surface hardness and paper may be outputted in a direction of a tangential line of the nip part.

A surface of a fixing belt 3 is heated by three heaters 5 incorporated in a heating roller 2. The heated fixing belt 3 heats and pressurizes an image to be fixed, at a fixing nip part between a fixing roller 1 and a pressure roller 10, thereby the image is fixed.

The fixing belt 3 is formed by covering a base material formed of a polyimide film with a surface layer of silicone rubber. The fixing roller 1 is formed by forming a rubber layer 6 over a roller core 4. The fixing belt 3 wrapped around the fixing roller 1 and the heating roller 2 is extended at a predetermined degree by a belt tension 14. The pressure roller 10 is formed by forming a rubber layer 13 over a core 11 and incorporates a heater 12. The heater 12 is provided to prevent a temperature fall of the fixing nip part by adding the heat from the pressure roller 10. Materials of the rubber layers 6 and 13 are silicone rubber, in order to improve heat resistance and color of the image. The thicknesses of the rubber layers 6 and 13 are changed, that is, the rubber layer 6 of the fixing roller is formed thicker so that the pressure roller 10 bites into the fixing roller 1 side.

In the belt fixing method, the fixing belt 3 and the pressure roller 10 both have surfaces formed of silicone rubber having an adhesion property. Therefore, a slight amount of silicone oil is applied onto the belt surface so that paper P can be easily peeled off. A fixing entry guiding board 7 for guiding the paper P to the fixing nip part is provided on an upstream side of the fixing nip part. The paper P which comes out of the fixing nip part, being guided to a lower surface of a paper separating unit 20, passes through between the paper separating unit 20 and a lower paper output guide 9 and then is outputted through between an upper paper output guide 8 and the lower paper output guide 9.

Figure 30:
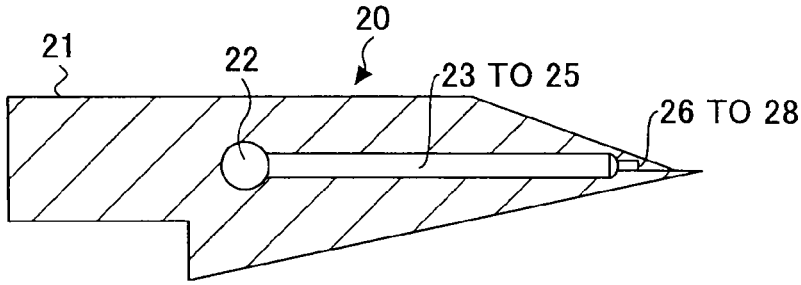
FIG. 30 is a cross-sectional view showing an enlarged part of a paper separating unit.
Figure 31A:
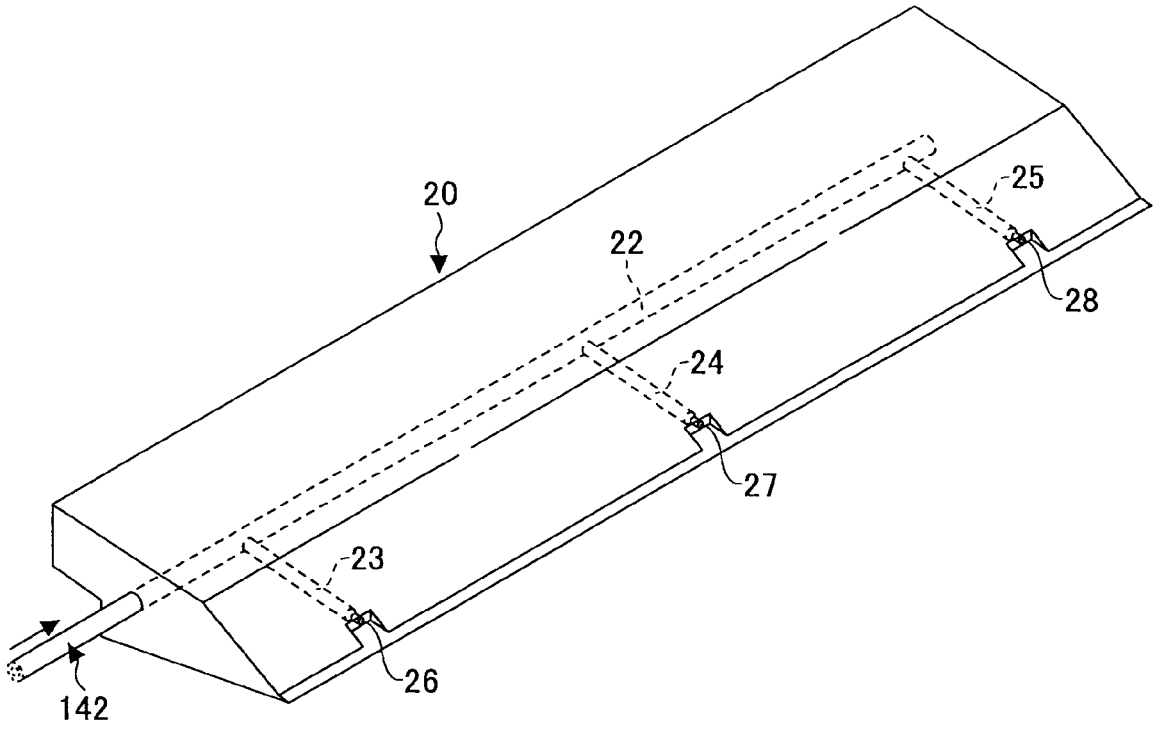
FIG. 31 is a perpendicular view of a paper separating unit.
Figure 31B:
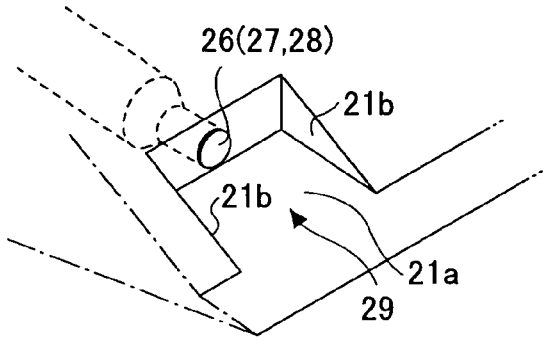

FIG. 30 is an enlarged cross-sectional view of the paper separating unit 20. FIGS. 31A and 31B are perpendicular views of the paper separating unit 20. A nozzle body 21 of the paper separating unit 20 incorporates a pipe line 22 extended in a longitudinal direction. The pipe line 22 is branched at three points, which are a central part and in the vicinities of opposing end parts in the longitudinal direction of the paper separating unit 20, forming branch pipe lines 23, 24, and 25 extended toward nozzle head ends. Front ends of the branch pipe lines 23, 24, and 25 are formed as small diameter parts. These small diameter parts form nozzles 26, 27, and 28, respectively, which serve as air discharge outlets. A cross-sectional shape of a front end part of the nozzle body 21 is acute-angled with a sharp front end as shown in FIG. 29. An air discharge outlet 29 provided at the front end part of the nozzle body 21 is surrounded and guided on three sides by a bottom surface part 21*a* provided at the front end part of the nozzle body 21 and wall parts 21*b* on opposing sides of the nozzle, to prevent dispersion of air discharged from each of the nozzles 26, 27, and 28, and discharge the air efficiently to the fixing nip part. One end part of the pipe line 22 is open at an end surface of the nozzle body 21. An air tube 142 is fit in the open part of the pipe line 22. The air tube 142 is connected to the air discharge opening 141 (the boss 143 including the air discharge opening 141) of the above-described air discharging apparatus, so as to discharge air supplied by the air discharging apparatus from the nozzles 26, 27, and 28 to separate paper coming out of the fixing nip part (air separation). In this embodiment, the three sides of the air discharge outlet 29 of each nozzle are surrounded and guided as described above. Therefore, air is discharged from each nozzle straightly to the fixing nip part, exhibiting a strong impact. In this manner, paper can be reliably separated.

Figure 32:
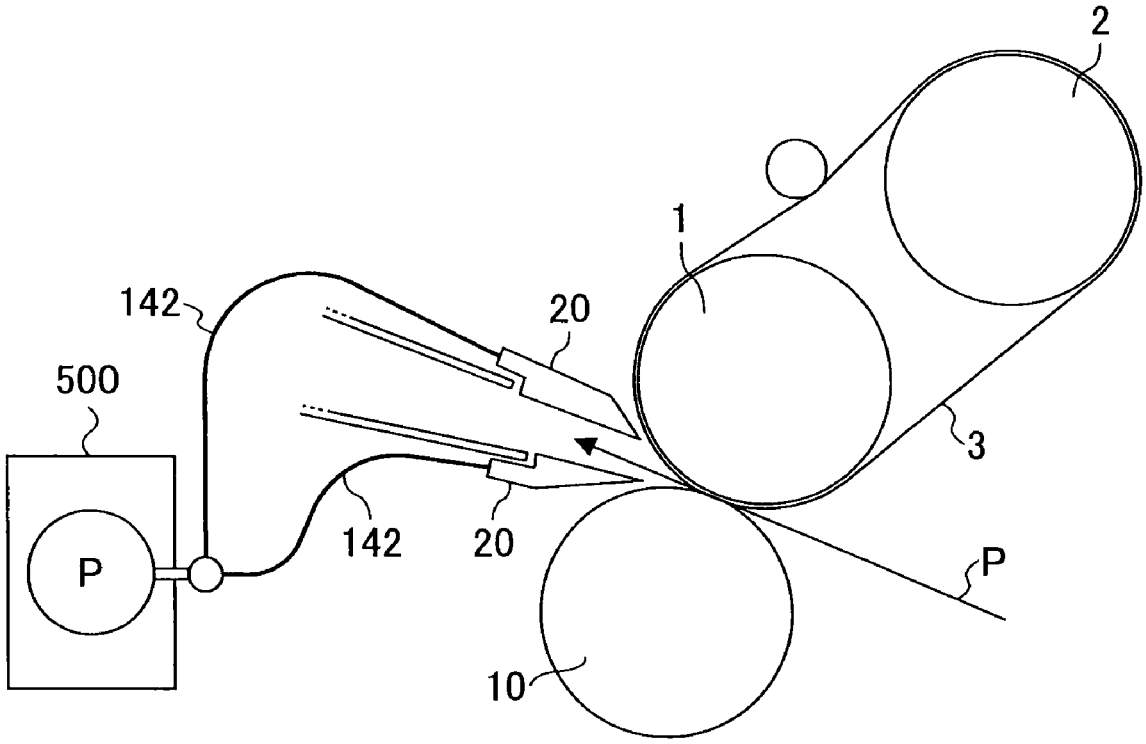
FIG. 32 is a schematic view showing a configuration to provide paper separating units 20 for both a fixing roller and a pressure roller to perform air separation.

In some cases, paper may be wrapped around not only on the fixing roller side but the pressure roller side as well. Therefore, the paper separating unit 20 may be provided on the pressure roller 10 side as well to perform air separation. FIG. 32 shows a configuration to perform air separation by providing the paper separating units 20 for both the fixing roller 1 and the pressure roller 10. This configuration is particularly effective to prevent paper wrapping around in the case of double-sided printing. In double-sided printing, a surface of paper, where an image is fixed first, faces the pressure roller 10 side in the next fixing of an image (back side printing). Therefore, the paper is easily wrapped around the pressure roller 10 side. However, by providing the paper separating unit 20 for the pressure roller 10 side to perform air separation, paper wrapping around the roller in the double-sided printing can be effectively prevented.

To prevent paper from wrapping around on the fixing roller 1 side, the pressure roller 10 is configured to bite into the fixing roller 1 so as to enhance a separating property of paper on the fixing roller 1 side in FIG. 29. In the configuration where the paper separating units 20 are provided for both the fixing roller 1 and the pressure roller 10, the fixing roller and the pressure roller 10 are evenly deformed so as to output paper in a direction of a tangential line. With such a configuration, a pressure at the fixing nip part can be balanced and generation of wrinkles and the like of paper can be prevented.

With a configuration where air is supplied by using the air discharging apparatus of the present invention to the paper separating units 20 provided for both a fixing roller and a pressure roller, air separation can be performed for both the fixing roller and the pressure roller even in an image forming apparatus with limited space, because the air discharging apparatus is small in size. Thus, more reliable paper separation can be realized and a paper jam caused by paper wrapping around a roller can be prevented. By appropriately setting a capacity of the air discharging apparatus, one air discharging apparatus can manage supplying air to both the paper separating units 20 of the fixing roller and the pressure roller.

Figure 33:
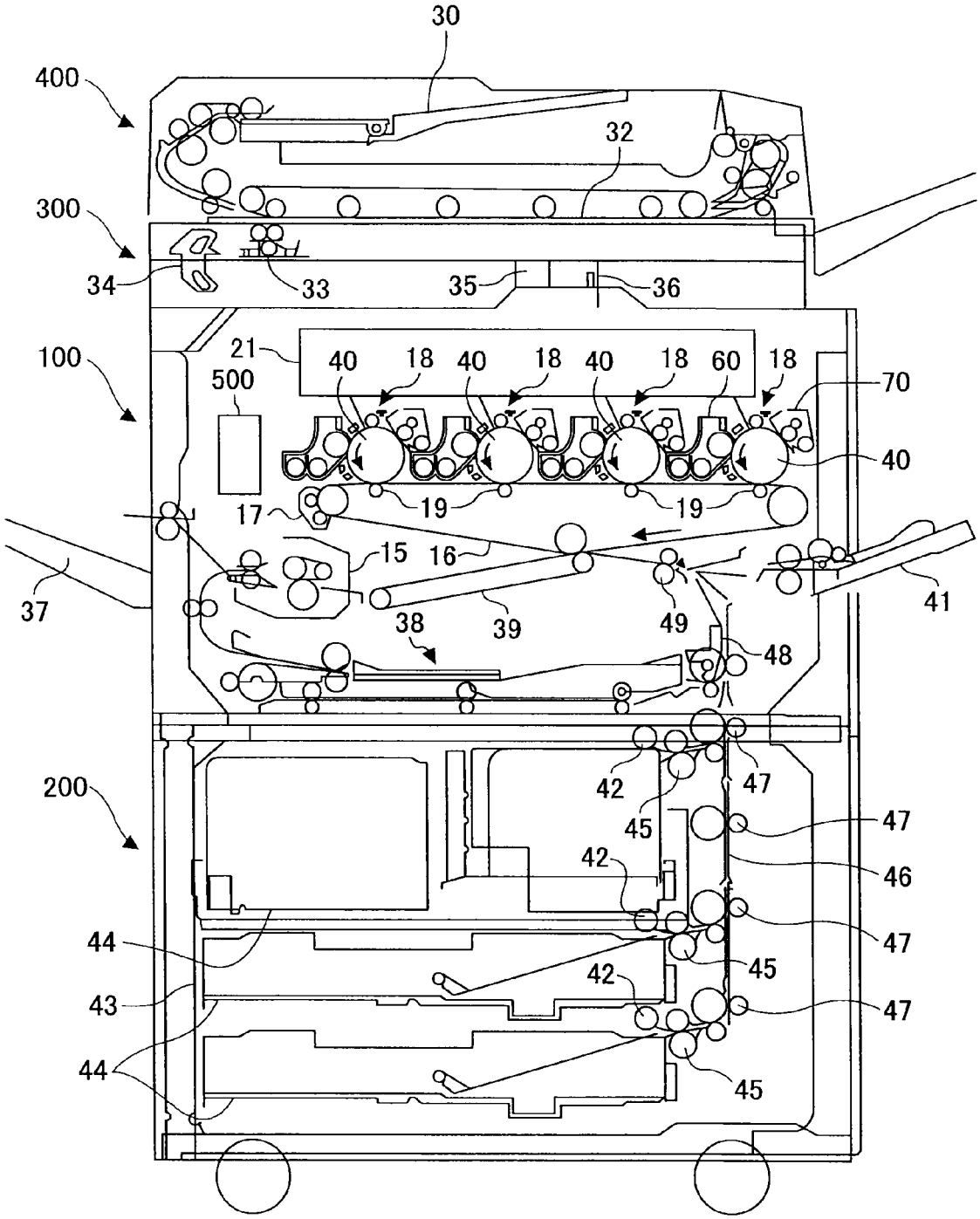
FIG. 33 is a cross-sectional configuration diagram showing an example of an image forming apparatus having an air discharging apparatus of the present invention.
Figure 34:
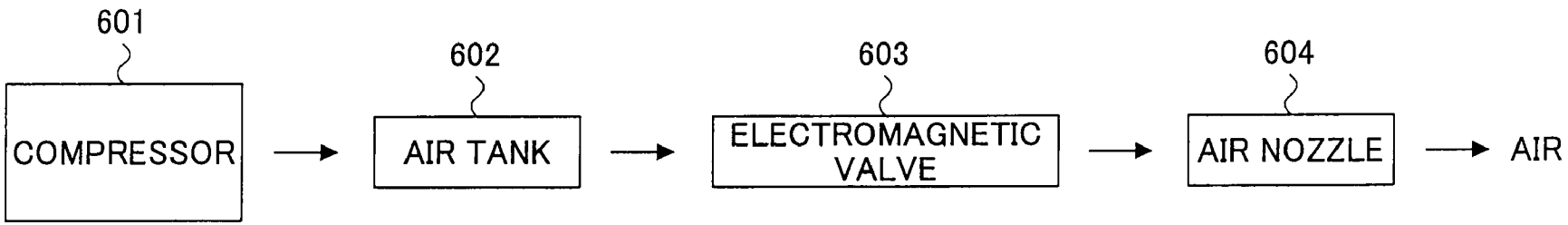
FIG. 34 is a block diagram showing a configuration example of a conventional air supply system.

At last, an example of an image forming apparatus provided with the fixing apparatus 15 is described. An image forming apparatus shown in FIG. 33 is a multifunction peripheral including a multifunction peripheral body 100 at a center and a paper feed unit 200 formed of tables below the multifunction peripheral body 100, a scanner 300 above the multifunction peripheral 100, and an automatic document feeder (ADF) 400 above the scanner 300.

The multifunction peripheral body 100 is provided with an intermediate transfer belt 16 serving as a latent image support, which is formed of a flexible endless belt wrapped around plural support rollers. The intermediate transfer belt 16 is driven by a driving apparatus which is not shown to run clockwise, that is a direction of an arrow shown in FIG. 33. Imaging units 18 of black, cyan, magenta, and yellow are arranged horizontally over a top side of the intermediate transfer belt 16 which runs as described above. That is, four image forming units 18 are arranged side by side to constitute a tandem imaging unit.

The respective four imaging units 18 have photosensitive body drums 40 serving as latent image supports contacting the intermediate transfer belt 16. A charger, a developer, a cleaner, an antistatic device, and the like are provided around the photosensitive body drums 40. Further, primary transfer devices 19 are arranged inside the intermediate transfer belt 16 at positions where the photosensitive body drums 40 contact the intermediate transfer belt 16. In this embodiment, the four imaging units 18 have the same configurations, but different toner colors of the developers, which are black, cyan, magenta, and yellow. In FIG. 33, a developer and a cleaner of only the imaging unit 18 at the right end are provided with reference numerals of 60 and 70 respectively.

An exposure apparatus 21 for irradiating surfaces of the photosensitive body drums with a modulated laser light is provided above the imaging units 18. This laser light is emitted onto the photosensitive body drums between the charger and the developer.

A secondary transfer apparatus 39 is provided on an opposite side of the intermediate transfer belt 16 to the imaging units 18. The secondary transfer apparatus 39 is formed of a secondary transfer belt as an endless belt wrapped around two rollers, so that the secondary transfer belt is pressed onto a transfer facing roller with the intermediate transfer belt 16 interposed therebetween in the example of FIG. 33.

The fixing apparatus 15 described above is provided on a left side of the secondary transfer apparatus 39 in FIG. 33. The secondary transfer apparatus 39 has a sheet transfer function to transfer a sheet, on which an image is transferred, to the fixing apparatus 15. A sheet inverting apparatus 38 to invert the sheet to record images on both sides of the sheet is provided below the secondary transfer apparatus 39 and the fixing apparatus 15.

Description is made below on the case of making a copy by using a color multifunction peripheral configured as described above. First, a document is set on a document stage 30 of the automatic document feeder 400. Alternatively, the automatic document feeder 400 is opened, a document is set on a contact glass 32 of the scanner 300, and the automatic document feeder 400 is closed to press the document.

When a start switch (not shown) is pressed, the scanner 300 is driven to run a first running body 33 and a second running body 34, right away when the document is set on the contact glass 32, or after the document set on the document stage 30 of the automatic document feeder 400 is transferred onto the contact glass 32. Light is emitted by a light source of the first running body 33, the light reflected on a surface of the document is further reflected to be emitted to the second running body 34, the light is then reflected by a mirror of the second running body 34 and sent into a reading sensor 36 through an imaging lens 35 so that contents of the document are read.

Further, when the start switch (not shown) is pressed, the intermediate transfer belt 16 rotates and runs. At the same time, the photosensitive bodies 40 of the imaging units 18 are rotated to form monochrome images of black, yellow, magenta, and cyan on the respective photosensitive bodies 40. In accordance with the running intermediate transfer belt 16, the monochrome images are sequentially transferred to form a synthetic color image on the intermediate transfer belt 16.

Further, when the start switch is pressed, one of paper feed rollers 42 in the paper feed unit 200 is selectively rotated and driven to pick up a sheet from one of paper feed cassettes 44 provided in plural stages in a paper bank 43. The sheet is separated one by one by a separating roller 45 to be transferred into a paper feed path 46, transferred by a transfer roller 47 to be guided to a paper feed path 48 in the multifunction peripheral body 100, and stopped at a resist roller 49.

Alternatively, when a manual paper feeding is selected, a sheet is fed from a manual tray 41, separated as one sheet to be transferred into a manual paper feed path, and stopped at the resist roller 49 as well.

Then, the resist roller 49 is rotated at a timing adjusted with the synthetic color image on the intermediate transfer belt 16, the sheet is transferred between the intermediate transfer belt 16 and the secondary transfer apparatus 39, and the synthetic color image is transferred by the secondary transfer apparatus 39 onto the sheet to record a full color image together on the sheet.

The sheet after the image is transferred is transferred by the secondary transfer apparatus 39 to the fixing apparatus 15. After a heat and pressure are applied by the fixing apparatus 15 to fix the transferred image, the sheet is outputted by an output roller and stacked on a paper output tray 37. Alternatively, a switching claw is used to switch a transfer direction of the sheet to transfer the sheet into a sheet inverting apparatus 38, where the sheet is inverted and transferred again to an image transfer position. At the image transfer position, after an image is recorded on a back surface of the sheet, the sheet is outputted by the output roller onto the paper output tray 37.

On the other hand, remaining toner existing on the intermediate transfer belt 16 after transferring the image is removed by an intermediate transfer body cleaning apparatus 17 to prepare for forming an image again by the tandem imaging unit.

The fixing apparatus 15 includes the paper separating unit 20 as described above. Air is supplied by the air discharging apparatus 500 and discharged from the nozzles 26, 27, and 28 of the paper separating unit 20 rapidly to the fixing nip part so as to reliably separate (air separation) paper coming out of the fixing nip part. As described above, since the air discharging apparatus of the present invention has achieved downsizing, it is possible to mount the air discharging apparatus of the present invention in an image forming apparatus as a supply source of separation air for a fixing apparatus. A conventional air supply system provided with a compressor and an air tank has been unavoidably large in size and limited to be used only in a commercial printing apparatus and the like. However, reliable paper separation by the air separation method is realized in an image forming apparatus set in an office and the like as well. As the air discharging apparatus 500, either of the first and second embodiments can be employed.

The present invention has been described with reference to the examples in the drawings, however, the present invention is not limited to these examples. For example, appropriate shapes can be employed for the cylinder and air pump. Moreover, a capacity of the air pump, a timing to discharge air, and the like can be appropriately set.

In the case of using the air discharging apparatus in an image forming apparatus, air separation or an air transfer method can be employed not only for separating (peeling off) paper at the fixing apparatus, but also for separating and transferring paper in a paper feed unit. Further, configurations and the like of the fixing apparatus and parts of the image forming apparatus are arbitrarily set. The present invention can be applied not only to a color image forming apparatus, but also to a monochrome image forming apparatus. The image forming apparatus is not limited to a multifunction peripheral, but may be a printer, a facsimile machine, or a multifunction peripheral having plural functions.

According to one embodiment, the opening and closing member mechanically coupled to the piston is provided at the air discharge opening, whereby the opening and closing member (that is, the air discharge opening) can be closed until a predetermined timing in the compressing step, and the air discharge opening can be opened in a short time around the top dead point. Therefore, pressure of air in the cylinder can be increased, and a burst of air with the increased pressure can be discharged. Therefore, a quite smaller and less expensive air discharging apparatus can be provided as compared to the conventional air supply system including a compressor, an air tank, and an electromagnetic valve. Moreover, such a noise generated in the case of using a compressor is not generated. Thus, an application range of the air discharging apparatus of the present invention can be remarkably widened. That is, the air discharging apparatus of the present invention can be mounted not only in a commercial apparatus, but also in various general purpose small-sized apparatuses used in an office. In those various apparatuses, air discharging function is realized.

According to one embodiment, the opening and closing member (that is, the air discharge opening) can be closed when the returning piston is at a predetermined position.

According to one embodiment, a pressure of discharged air can be increased and the air can be discharged at a high speed.

According to one embodiment, air can be sequentially discharged in accordance with one reciprocating operation of the piston.

According to one embodiment, opening and closing of the air discharge opening can be performed by using a rotation shaft having a simple configuration.

According to one embodiment, pressures and speeds of air discharged passing by the both sides (each side) of the flat plate part can be set equal to each other.

According to one embodiment, opening and closing of the air discharge opening can be performed by using a sliding member having a simple configuration.

According to one embodiment, by using an end face cam, the sliding type opening and closing member can be opened and closed with a simple configuration.

According to one embodiment, opening and closing of the opening and closing member can be switched at a desired timing by appropriately setting a shape of the cam member.

According to one embodiment, the piston can be moved linearly (reciprocated in parallel to the cylinder) with a high precision, and leakage of air or abrasion and breakage of the cylinder and piston can be suppressed.

According to one embodiment, a pressure and an amount of discharged air can be changed by changing a moving stroke of the piston.

According to one embodiment, a pressure to discharge air can be changed by changing a moving speed of the piston. Further, a low torque driving can be performed with the same cycle as the case of driving at a constant speed.

According to one embodiment, by controlling the stepping motor, an amount and a pressure of discharged air can be easily changed.

According to one embodiment, a sliding property of the piston and the cylinder can be improved. Since no oil is used, oil does not get into air. Further, abrasion resistance can be improved and durability of the piston and cylinder can be extended.

According to one embodiment, rotation of the piston is prevented and an influence on the driving system can be prevented.

According to one embodiment, the crank mechanism is used to drive the air pump and a burst of air with increased pressure can be discharged.

According to one embodiment, a timing to discharge air can be changed simply and inexpensively.

According to one embodiment, by using a small-sized and inexpensive air discharging apparatus as an air supply source for a separating unit in a fixing apparatus, reliable paper separation can be performed by employing air separation in an image forming apparatus with a size and price for usage in an office and the like.

According to one embodiment, reliable paper separation can be performed by discharging air from the air discharge opening provided in at least the central part and the vicinities of opposing end parts in the longitudinal direction of the nozzle body in the separating unit.

According to one embodiment, reliable paper separation can be performed by preventing air dispersion and discharging air efficiently to the fixing nip part.

According to one embodiment, paper can be more reliably separated by an additionally applied curvature separating effect of the heating rotation member.

According to one embodiment, wrapping around of paper to the pressure rotation member side can be prevented, and wrapping around of paper in the case of double-sided printing can be effectively prevented.

According to one embodiment, by employing the belt fixing method, a heat capacity of the fixing member can be reduced and the temperature can be quickly raised. Further, reliable paper separation can be performed in the belt fixing method.

This patent application is based on Japanese Priority Patent Application No. 2008-118734 filed on Apr. 30, 2008, and Japanese Priority Patent Application No. 2008-225963 filed on Sep. 3, 2008, the entire contents of which are hereby incorporated herein by reference.

What is claimed is:

1. An air discharging apparatus to discharge pressurized air, comprising:

an air pump including a cylinder and a piston configured to reciprocate in the cylinder;

an opening and closing member at an air discharge opening of the air pump and configured to open and close the air discharge opening; and a switching mechanism providing mechanical coupling between the piston and the opening and closing member, the mechanical coupling being configured to keep the opening and closing member in a closed state until the piston reaches a predetermined position in a compression stroke and switch the opening and closing member to an opened state when the piston reaches the predetermined position, wherein:

the opening and closing member includes a sliding member arranged crossing the air discharge opening, a small volume part in the sliding member at a position crossing the air discharge opening, and the air discharge opening is opened and closed by moving the sliding member a predetermined distance, and the sliding member is slid by an end face cam.

2. The air discharging apparatus as claimed in claim 1, wherein the mechanical coupling switches the opening and closing member to the closed state when the piston reaches the predetermined position in a returning stroke.

3. The air discharging apparatus as claimed in claim 1, wherein the predetermined position is in a vicinity of a top dead point of the piston.

4. The air discharging apparatus as claimed in claim 1, wherein the air pump performs operations of compressing air, discharging air, and introducing air in one reciprocating operation of the piston.

5. The air discharging apparatus as claimed in claim 1, wherein the switching mechanism includes a cam member rotating in conjunction with a movement of the piston, and the end face cam serving as the opening and closing member is rotated via the cam member.

6. The air discharging apparatus as claimed in claim 1, further comprising a guiding unit configured to reciprocate the piston in parallel to the cylinder.

7. The air discharging apparatus as claimed in claim 6, wherein a driving source of the air pump is a stepping motor, and at least one of the moving stroke and the moving speed of the piston can be changed by controlling the stepping motor.

8. The air discharging apparatus as claimed in claim 1, wherein at least one of a moving stroke and a moving speed of the piston is variable.

9. The air discharging apparatus as claimed in claim 1, wherein the piston and the cylinder are formed of a low friction material.

10. The air discharging apparatus as claimed in claim 1, wherein each of the piston and the cylinder has a circular cross-sectional shape and includes a rotation preventive unit configured to prevent rotation of the piston.

11. The air discharging apparatus as claimed in claim 1, further comprising a crank mechanism configured to reciprocate the piston, a motor serving as a driving unit of the crank mechanism and configured to rotate in one direction, and one rotation clutch between the crank mechanism and the motor, wherein when the clutch is engaged, a crank shaft of the crank mechanism rotates once and the piston reciprocates once, by which operations of compressing air, discharging air, and introducing air are performed.

12. The air discharging apparatus as claimed in claim 11, wherein the switching mechanism includes a cam member configured to rotate in conjunction with a movement of the piston, and a timing to discharge air can be changed by changing a shape or a position in a rotation direction of the cam member.

13. An image forming apparatus comprising:

a heating rotation member configured to heat a recording sheet;

a pressure rotation member configured to contact a surface of the heating rotation member to form a nip part;

a fixing apparatus including a separating unit configured to separate the recording sheet by air from the heating rotation member; and the air discharging apparatus as claimed in claim 1, to supply air from the air discharging apparatus to the separating unit.

14. The image forming apparatus as claimed in claim 13, wherein the separating unit includes a nozzle body in a shape of a separating claw, and a discharge opening of the air supplied from the air discharging apparatus in at least a central part and vicinities of opposing end parts in a longitudinal direction of the nozzle body.

15. The image forming apparatus as claimed in claim 14, wherein the nozzle body has a guiding part surrounding three sides of the discharge opening and configured to guide a direction of discharged air.

16. The image forming apparatus as claimed in claim 13, further comprising:

an inlet valve which includes a leaf valve.

17. The air discharge apparatus as claimed in claim 1, further comprising:

an inlet valve which includes a leaf valve.

* * * * *